US012173503B2

(12) United States Patent
Svec et al.

(10) Patent No.: US 12,173,503 B2
(45) **Date of Patent: *Dec. 24, 2024**

(54) METAL ROOFING SHINGLES WITH SIDE LAP AND HEADLAP ALIGNMENT AND SEALING FEATURES

(71) Applicant: Building Materials Investment Corporation, Dallas, TX (US)

(72) Inventors: James A. Svec, Kearny, NJ (US); Eric R. Anderson, Montclair, NJ (US); Steven V. Boehling, Wilmington, NC (US)

(73) Assignee: BMIC LLC, Dallas, TX (US)

( * ) Notice: Subject to any disclaimer, the term of this patent is extended or adjusted under 35 U.S.C. 154(b) by 237 days.

This patent is subject to a terminal disclaimer.

(21) Appl. No.: 17/225,243

(22) Filed: Apr. 8, 2021

(65) Prior Publication Data

US 2021/0317662 A1 Oct. 14, 2021

Related U.S. Application Data

(60) Provisional application No. 63/105,498, filed on Oct. 26, 2020, provisional application No. 63/020,353, (Continued)

(51) Int. Cl.
*E04D 1/18* (2006.01)
*E04D 1/00* (2006.01)

(52) U.S. Cl.
CPC ..... *E04D 1/2942* (2019.08); *E04D 1/18* (2013.01); *E04D 1/2916* (2019.08); *E04D 1/2918* (2019.08); *E04D 1/2956* (2019.08)

(58) Field of Classification Search
CPC ..... E04D 1/34; E04D 1/3405; E04D 1/29; E04D 1/2907; E04D 1/2914;
(Continued)

(56) References Cited

U.S. PATENT DOCUMENTS 220,181 A 9/1879 Slaughter
424,149 A * 3/1890 Toner et al.
(Continued)

FOREIGN PATENT DOCUMENTS

CH 346993 A 6/1960
CN 108149849 A 6/2018
(Continued)

OTHER PUBLICATIONS

S&T Metals; https://www.stmetals.net/commerical-metal-roofing/custom-metal-roofing/; Custom Metal Roofing; Custom Metal Roofing Made right on the Job-site by S&T Metals; dated Dec. 30, 2019.
(Continued)

*Primary Examiner* — Jessica L Laux
(74) *Attorney, Agent, or Firm* — Womble Bond Dickinson (US) LLP

(57) ABSTRACT

A roofing system has metal shingles that have formed side lap features that are configured to facilitate alignment of adjacent side lapped metal shingles of a shingle installation along a roofing structure and that couple the metal shingles together and form seals along their side lapped peripheral edges. The metal shingles also can have alignment features that cooperate to align shingles in one course with shingles in a next lower course within their headlap regions.

18 Claims, 14 Drawing Sheets

Related U.S. Application Data filed on May 5, 2020, provisional application No. 63/010,458, filed on Apr. 15, 2020, provisional application No. 63/009,806, filed on Apr. 14, 2020.

(58) Field of Classification Search

CPC ... E04D 1/2916; E04D 1/2918; E04D 1/2921; E04D 1/2935; E04D 1/2942; E04D 1/2956; E04D 1/2949; E04D 1/36; E04D 1/365; E04D 1/06; E04D 1/12; E04D 1/18; E04D 1/265; E04D 2001/3414; E04D 2001/3432; E04D 2001/3476; E04D 2001/3482; E04D 2001/3494

See application file for complete search history.

(56) References Cited

U.S. PATENT DOCUMENTS 466,198 A * 12/1891 Thorn
550,325 A 11/1895 Kinnear
662,262 A * 11/1900 Galvin
884,285 A * 4/1908 Moomaw
1,329,794 A 2/1920 Moomaw
1,539,632 A 5/1925 Belding
1,743,206 A 1/1930 Fulenwider et al.
2,042,890 A 6/1936 Fulenwider et al.
2,173,774 A * 9/1939 Birch ..... E04D 3/363 52/522
3,138,897 A 6/1964 McCorkle
3,269,075 A 8/1966 Marini et al.
3,347,001 A * 10/1967 Cosden ..... E04D 3/363 52/522
3,363,380 A 1/1968 Merrill
3,412,517 A 11/1968 Ellis et al.
3,434,259 A 3/1969 Corbin
3,462,805 A 8/1969 Quisling
3,481,094 A 12/1969 Taylor
3,601,947 A 8/1971 Hurd
3,720,031 A 3/1973 Wilson et al.
3,760,546 A 9/1973 Martin et al.
3,848,383 A 11/1974 Wilson et al.
4,010,590 A 3/1977 Reinke
4,079,561 A 3/1978 Vallee
4,135,342 A 1/1979 Cotter
4,189,889 A 2/1980 Yanoh
4,269,012 A 5/1981 Mattingly et al.
4,343,126 A 8/1982 Hoofe, III
4,445,305 A 5/1984 Orie, Sr.
4,468,903 A 9/1984 Eaton et al.
4,497,151 A 2/1985 Simpson et al.
4,499,700 A 2/1985 Gustafsson
4,648,218 A 3/1987 Butzen
4,655,020 A 4/1987 Ginn, Jr.
4,754,589 A 7/1988 Leth
4,824,880 A * 4/1989 Algrim ..... E04D 1/29 524/68
4,932,184 A 6/1990 Waller
5,074,093 A 12/1991 Meadows
5,295,338 A 3/1994 Guffey et al.
5,295,339 A 3/1994 Manner
5,349,801 A 9/1994 Verbofsky
5,465,543 A 11/1995 Seifert
5,469,680 A 11/1995 Hunt
5,479,753 A 1/1996 Williams
5,495,654 A 3/1996 Goodhart et al.
5,535,567 A 7/1996 Cahoon
5,598,677 A 2/1997 Rehm, III
5,613,337 A 3/1997 Plath et al.
5,636,481 A 6/1997 De Zen
5,642,596 A 7/1997 Waddington
5,664,451 A 9/1997 Schultz
5,671,577 A 9/1997 Todd
5,685,117 A * 11/1997 Nicholson ..... E04D 1/18 52/557
5,685,118 A 11/1997 Simpson
5,752,355 A 5/1998 Sahramaa
5,768,844 A 6/1998 Grace, Sr. et al.
5,881,501 A 3/1999 Guffey et al.
D414,568 S 9/1999 Hedges et al.
6,105,314 A 8/2000 Stocksieker
6,173,546 B1 * 1/2001 Schafer ..... E04D 1/18 52/522
6,272,807 B1 8/2001 Waldrop
6,282,858 B1 9/2001 Swick
D449,121 S 10/2001 Hunter et al.
RE38,210 E 8/2003 Plath et al.
6,647,687 B2 11/2003 Kern
6,772,569 B2 8/2004 Bennett et al.
6,907,701 B2 6/2005 Smith
6,912,822 B2 7/2005 Vos
6,928,781 B2 8/2005 Desbois et al.
7,188,774 B2 3/2007 Pinchen et al.
7,246,474 B2 7/2007 Dombek et al.
7,596,919 B1 10/2009 Vande Hey et al.
7,658,038 B2 2/2010 Mower et al.
7,690,169 B2 4/2010 Saarenko et al.
7,712,278 B2 5/2010 Lonardi
7,739,848 B2 6/2010 Trout
7,748,191 B2 7/2010 Podirsky
7,900,414 B2 3/2011 Seccombe
D643,133 S 8/2011 Steffes et al.
8,028,474 B2 10/2011 Beck et al.
8,028,475 B2 10/2011 Sigmund et al.
8,074,417 B2 12/2011 Trabue et al.
8,132,372 B2 3/2012 Mower et al.
8,145,578 B2 3/2012 Pershing et al.
8,171,689 B2 5/2012 Pierson et al.
8,297,020 B1 * 10/2012 Swanson ..... E04D 1/26 52/412
8,316,603 B2 11/2012 Flynn et al.
8,316,609 B2 11/2012 Ben-Zvi
8,590,270 B2 11/2013 Martinique
8,677,709 B2 3/2014 DiLonardo et al.
D707,856 S 6/2014 Cochrane
8,806,827 B2 8/2014 Perttula et al.
8,834,993 B2 9/2014 Yang
8,863,461 B2 10/2014 Wagner et al.
8,898,963 B1 12/2014 Amatruda et al.
8,898,987 B1 12/2014 Amatruda et al.
8,925,272 B1 1/2015 Amatruda et al.
8,991,129 B1 3/2015 Kramer
9,003,733 B1 4/2015 Simpson et al.
9,091,082 B2 7/2015 Wakebe
9,097,019 B1 8/2015 Rasmussen et al.
9,127,451 B1 9/2015 Boor
9,181,702 B2 11/2015 Rasmussen et al.
9,181,703 B2 11/2015 Rasmussen et al.
9,181,704 B2 11/2015 Rasmussen et al.
9,206,606 B2 12/2015 Jaks
9,212,488 B1 12/2015 McGraw et al.
9,267,289 B2 2/2016 Vander Laan et al.
D754,885 S 4/2016 Rasmussen et al.
9,334,652 B2 5/2016 Plath et al.
9,356,174 B2 5/2016 Duarte et al.
9,404,262 B1 8/2016 Smith, Jr.
9,435,125 B2 9/2016 Wakebe
9,493,955 B1 11/2016 Christian
9,574,351 B2 2/2017 Karr et al.
9,593,488 B2 3/2017 Rasmussen et al.
9,605,432 B1 3/2017 Robbins
9,689,164 B2 6/2017 Rasmussen et al.
9,708,814 B2 7/2017 Vander Laan et al.
9,813,016 B2 11/2017 Chabas et al.
9,890,537 B2 2/2018 Martin et al.
9,919,835 B2 3/2018 Brisendine et al.
9,970,197 B2 5/2018 Maurer et al.
10,027,274 B2 7/2018 Van Giesen et al.
10,132,085 B2 11/2018 Bredeweg et al.
10,196,807 B2 2/2019 Kwong
10,233,645 B2 3/2019 Izumi et al.
10,294,669 B2 5/2019 Prygon
10,316,519 B2 6/2019 Bogh et al.
10,422,138 B1 9/2019 French et al.
10,465,384 B2 11/2019 Bogh et al.

(56) References Cited

U.S. PATENT DOCUMENTS

| | | | |
|---|---|---|---|
| 10,538,905 | B2 | 1/2020 | Pirrung |
| 10,544,593 | B2 | 1/2020 | Schultz et al. |
| 10,560,048 | B2 | 2/2020 | Fisher et al. |
| 10,590,652 | B2 | 3/2020 | Dye et al. |
| 10,596,612 | B2 | 3/2020 | Jordan |
| 10,612,231 | B2 | 4/2020 | Nieminen |
| 10,731,347 | B2 | 8/2020 | Parsons et al. |
| 10,742,159 | B2 | 8/2020 | Sabban |
| 10,749,460 | B2 | 8/2020 | Guo |
| D898,956 | S | 10/2020 | Folkersen |
| 10,808,403 | B2 | 10/2020 | Bodwell et al. |
| 10,817,838 | B1 | 10/2020 | Jalla |
| 10,822,800 | B2 | 11/2020 | Kraft |
| 10,866,012 | B2 | 12/2020 | Kvasnicka et al. |
| 10,876,304 | B2 | 12/2020 | Shaw |
| 10,895,076 | B1 | 1/2021 | Folkersen et al. |
| 10,920,429 | B2 | 2/2021 | Shaw |
| 10,968,634 | B2 | 4/2021 | Bolo |
| 11,025,192 | B2 | 6/2021 | Livsey et al. |
| 11,220,817 | B2 | 1/2022 | Hortom |
| 11,236,510 | B2 | 2/2022 | Stephan et al. |
| 11,248,377 | B1 | 2/2022 | Wang et al. |
| 11,261,603 | B2 | 3/2022 | Izumi et al. |
| 11,384,542 | B2 | 7/2022 | DeRogatis et al. |
| 11,447,954 | B2 | 9/2022 | McDonald |
| 11,492,808 | B2 | 11/2022 | Shaw |
| 11,603,660 | B2 | 3/2023 | Anderson et al. |
| 11,639,604 | B1 | 5/2023 | Smith, Jr. |
| 11,813,703 | B2 | 11/2023 | Humphreys et al. |
| 2005/0210808 | A1 | 9/2005 | Larson et al. |
| 2006/0037279 | A1 | 2/2006 | Onchuck |
| 2006/0204721 | A1 | 9/2006 | Hori et al. |
| 2007/0137132 | A1 | 6/2007 | Plowright |
| 2007/0181174 | A1 | 8/2007 | Ressler |
| 2008/0028691 | A1 | 2/2008 | Alvarez |
| 2008/0262789 | A1 | 10/2008 | Pershing et al. |
| 2009/0117329 | A1 | 5/2009 | Leitch et al. |
| 2010/0186334 | A1 | 7/2010 | Seem |
| 2010/0296693 | A1 | 11/2010 | Thornberry et al. |
| 2010/0313506 | A1 | 12/2010 | Schoell |
| 2011/0041446 | A1 | 2/2011 | Stephens et al. |
| 2012/0227343 | A1 | 9/2012 | Curtin et al. |
| 2013/0186028 | A1 | 7/2013 | Resso et al. |
| 2014/0165480 | A1 | 6/2014 | Jenkins et al. |
| 2014/0190096 | A1 | 7/2014 | Kacandes |
| 2014/0190104 | A1 | 7/2014 | Nicholson |
| 2015/0354224 | A1 | 12/2015 | Maurer et al. |
| 2016/0123013 | A1 | 5/2016 | Rasmussen et al. |
| 2017/0019061 | A1 | 1/2017 | Van Giesen et al. |
| 2018/0183382 | A1 | 6/2018 | Hall et al. |
| 2018/0347194 | A1 | 12/2018 | Champion |
| 2018/0347195 | A1 | 12/2018 | Whitridge, Jr. et al. |
| 2019/0100920 | A1 | 4/2019 | Krause |
| 2019/0186139 | A1 | 6/2019 | Piltch |
| 2020/0040582 | A1 | 2/2020 | Boss et al. |
| 2021/0071410 | A1 | 3/2021 | Kralic et al. |
| 2021/0079655 | A1 | 3/2021 | Swaya, Jr. |
| 2021/0102382 | A1 | 4/2021 | Shaw |
| 2021/0115670 | A1 | 4/2021 | Guerra |
| 2021/0131094 | A1 | 5/2021 | Cullen |
| 2021/0156150 | A1 | 5/2021 | Boss et al. |
| 2021/0222432 | A1 | 7/2021 | Anderson et al. |
| 2021/0222865 | A1 | 7/2021 | Beck et al. |
| 2021/0262241 | A1 | 8/2021 | Thomson |
| 2021/0285218 | A1 | 9/2021 | Lowe |
| 2021/0301534 | A1 | 9/2021 | Svec et al. |
| 2021/0317661 | A1 | 10/2021 | Svec et al. |
| 2021/0332539 | A1 | 10/2021 | Lee et al. |
| 2022/0064955 | A1 | 3/2022 | Nelson, Jr. |
| 2022/0173693 | A1 | 6/2022 | Atchley et al. |
| 2022/0195733 | A1 | 6/2022 | Nash et al. |
| 2022/0251844 | A1 | 8/2022 | Flett |
| 2022/0298794 | A1 | 9/2022 | Tripod |
| 2022/0307262 | A1 | 9/2022 | Humphreys |
| 2023/0183970 | A1 | 6/2023 | Anderson et al. |

FOREIGN PATENT DOCUMENTS

| | | | |
|---|---|---|---|
| CN | 208072785 | U | 11/2018 |
| DE | 9201477 | U1 | 6/1992 |
| EP | 0204884 | A1 | 12/1986 |
| EP | 0550800 | A2 | 7/1993 |
| EP | 1989366 | B1 | 7/2009 |
| FR | 2569218 | A1 | 2/1986 |
| JP | 2001/164756 | A | 6/2001 |
| JP | 2003/127092 | A2 | 5/2003 |
| WO | WO2005/098168 | A2 | 10/2005 |
| WO | WO2012/136194 | A2 | 10/2012 |

OTHER PUBLICATIONS

JMAR Roofing & Sheet Metal; On-Site Roof Panel Manufacturing a Plus; available before Dec. 30, 2019.

Boral Steel Stone Coated Roofing; Batten-Less Installation Guidelines; BoralRoof.com; pp. 1-40; dated Oct. 2018.

Cost Comparison Helper; http://costcomparisonhelper.com/compare-prices/roofing/steel-roofing.html; Compare Average Cost of Steel Roofing InstallationISteel Roofing Price Quotes; ; pp. 1-4; available as of Nov. 20, 2014.

Guilford'S Seamless Gutters; http://guilfordsllc.com/metal-roof-profile-style-options/; Metal Roof Profile—Style Options Guilford's Metal Roofing; ; pp. 1-3; available as of Nov. 20, 2014.

Windows of Michigan; http://windowsofmichigan.com/products/metal-roofing/permanent-metal-shakes.html; Permanent Metal Shake; pp. 1-3; Nov. 20, 2014.

AMR-Advantage Metal Roofs; http://www.advantagementalroofs.com/country manor shake html; Austin Texas Metal Roofing Professionals—Advantage Metal Roofs; pp. 1-2; available as of Nov. 20, 2014.

International Search Report and the Written Opinion of the International Searching Authority for PCT/US2021/026343, mailed Jul. 8, 2021.

Partial Supplementary European Search Report for related European Application No. EP 21787714.1, dated Mar. 22, 2024.

* cited by examiner

METAL ROOFING SHINGLES WITH SIDE LAP AND HEADLAP ALIGNMENT AND SEALING FEATURES

REFERENCE TO RELATED APPLICATIONS

The present patent application claims the benefit of U.S. Provisional Patent Application No. 63/009,806, filed Apr. 14, 2020, U.S. Provisional Patent Application No. 63/010,458, filed Apr. 15, 2020, U.S. Provisional Patent Application No. 63/020,353, filed May 5, 2020, and U.S. Provisional Patent Application No. 63/105,498, filed Oct. 26, 2020.

INCORPORATION BY REFERENCE

The disclosures of U.S. Provisional Patent Application No. 63/009,806, filed Apr. 14, 2020, U.S. Provisional Patent Application No. 63/010,458, filed Apr. 15, 2020, U.S. Provisional Patent Application No. 63/020,353, filed May 5, 2020, and U.S. Provisional Patent Application No. 63/105,498, filed Oct. 26, 2020, are specifically incorporated by reference herein as if set forth in their entireties.

TECHNICAL FIELD

This disclosure relates generally to roofing shingles and more specifically to thin metal roofing shingles.

BACKGROUND

Metal roofing shingles and panels have become more popular. Such shingles may be installed in courses with horizontally adjacent shingles overlapping along a side lap and with shingles in one course overlapping shingles in a next lower course along a headlap. A need exists for metal roofing shingles with side lap features that facilitate correct alignment of horizontally adjacent shingles during installation. A further need exists for metal roofing shingles that can adhere and seal at their side laps when installed to prevent water incursion or penetration. A still further need exists for metal roofing shingles with features that can align and seal shingles on one course to shingles in a next lower course along their headlap regions. It is to the provision of such roofing shingles that the present disclosure is primarily directed.

SUMMARY

Briefly described, is directed to a roofing system including a plurality of roofing shingles, and a method of forming a roof structure therewith. The roofing shingles include metal roofing shingles made of thin metal sheets, strips or layers, but encompasses with equal measure roofing shingles made of any other appropriate material such as, for example, plastic, fiberglass, extruded aluminum, and polymer sheet materials, etc., and/or combinations thereof. In various embodiments, the roofing shingles also include side lap features that align side lapped shingles of a shingle installation and that adhere the roofing shingles together and form seals along their side laps. The roofing shingles also can have alignment features that cooperate to align the roofing shingles in one course with roofing shingles in a next lower course within their headlap regions.

Aspects of the roofing system of the present disclosure can include, without limitation a roof structure comprising a substrate; and a plurality of metal roofing shingles positioned over the substrate, wherein each of the metal roofing shingles comprises a body; and at least one side lap feature defined along a peripheral edge of the body; wherein the at least one side lap feature is configured to engage and interlock with a corresponding side lap feature of an adjacent metal roofing shingle to connect the metal roofing shingles in series on the substrate.

In embodiments of the roof structure, the metal roofing shingles are attached to the roofing substrate. In other embodiments of the roof structure, an underlayment material is positioned between the metal roofing shingles and the substrate.

In embodiments of the roof structure, the side lap features of the metal roofing shingles have a hooked, serrated, tongue and groove, arched or domed configuration adapted to cooperatively engage with the corresponding side lap feature of the adjacent metal roofing shingle. In some embodiments, the side lap features of the metal roofing shingles comprise a series of lobes and sockets configured to fit together in a mechanically interlocking engagement. In embodiments, the side lap features of the metal roofing shingles are adapted to engage and interlock in a press or snap-fitting arrangement.

In embodiments, a sealant material is applied along a bottom surface of each metal roofing shingle. In some embodiments, the sealant material comprises a pressure sensitive adhesive. In other embodiments, the sealant material further comprises a bead, strip, or patterned arrangement of a pressure sensitive adhesive with a release material covering strip applied thereto.

In some embodiments of the roof structure, the side lap features comprise slanted or angled projections or tabs positioned along the body of each metal roofing shingle. In embodiments, the projections or tabs are configured to bend in upward or downward directions.

In some embodiments, the side lap features comprise arched, rounded or raised ridge portions defined along at least one side edge of the body of each metal roofing shingles, the ridge portions defining recesses configured to receive a corresponding ridge portion of the corresponding side lap feature of the adjacent metal roofing shingle. In other embodiments, slots or cut-outs are formed along the side lap features of the metal roofing shingles, and wherein the side lap features of the plurality of metal roofing shingles inter-lock in a compressive fitted engagement.

In other aspects, a roof structure comprises a substrate and a plurality of roofing shingles, each of the roofing shingles having a body with at least one headlap portion and at least one side lap portion, and an interlocking feature defined along at least one of the at least one headlap portion or the at least one side lap portion; and wherein the interlocking features of each roofing shingle are configured to engage corresponding interlocking features of an adjacent roofing shingle to connect each of roofing shingles of the plurality of roofing shingles in series across the substrate.

In embodiments of the roof structure, the interlocking features comprise tongue and groove features, serrations, hooked features, domed or arched features, ridges, projections, tabs, or combinations thereof. In some embodiments, an adhesive material is applied along an area of overlap between the interlocking features of adjacent connected roofing shingles. In embodiments, the roofing shingles comprise metal roofing shingles.

Accordingly, embodiments of roofing shingles and methods for forming a roof structure that are directed to the above discussed and other needs are disclosed. The foregoing and other advantages and aspects of the embodiments of the present disclosure will become apparent and more readily appreciated from the following detailed description and the claims, taken in conjunction with the accompanying drawings. Moreover, it is to be understood that both the foregoing summary of the disclosure and the following detailed description are exemplary and intended to provide further explanation without limiting the scope of the present disclosure.

BRIEF DESCRIPTION OF THE DRAWINGS

The accompanying drawings, which are included to provide a further understanding of the embodiments of the present disclosure, are incorporated in and constitute a part of this specification, illustrate embodiments of this disclosure, and together with the detailed description, serve to explain the principles of the embodiments discussed herein. No attempt is made to show structural details of this disclosure in more detail than may be necessary for a fundamental understanding of the exemplary embodiments discussed herein and the various ways in which they may be practiced.

DETAILED DESCRIPTION

Reference will now be made in more detail to the attached drawing figures. Throughout this patent disclosure, the shingles will be referred to as "metal" shingles for purposes of clarity. It will be understood, however, that the present disclosure is not limited to shingles made of metal but encompasses with equal measure shingles made of any other appropriate material such as, for example, plastic, fiberglass, extruded aluminum, and polymer sheet material to name a few.

Embodiments of the present disclosure also are not limited to roofing structures, and can be used in conjunction with other portions of commercial or residential structures or portions thereof, such as perpendicular or slanted or slope walls or partitions both permanent and temporary and/or other structural portions, such as beams, columns, slabs, etc. or other portion of a commercial or residential structures.

Figure 1:
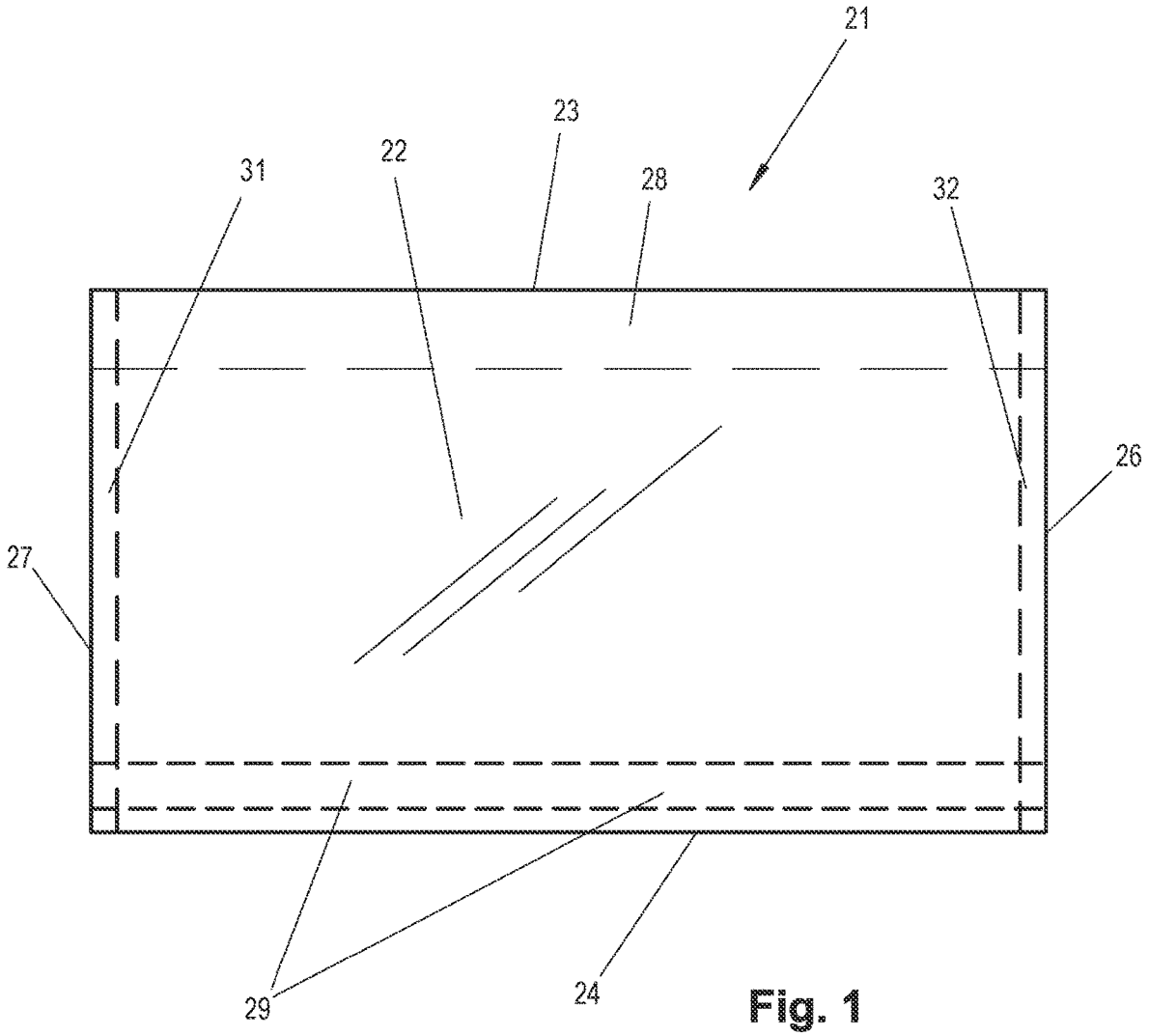
FIG. 1 is a top plan view of a thin metal roofing shingle indicating generally the various portions and features of the metal roofing shingle.

FIG. 1 shows a general metal roofing shingle of the type described in this disclosure. The shingle 21 is rectangular, as illustrated in FIG. 1, but other configurations also may be utilized. The shingle 21 has a top edge 23, a bottom edge 24, a right side edge 26, and a left side edge 27. An exposure portion 22 of the shingle is exposed to the elements when the shingle is installed. A headlap portion 28 of the shingle 21 is overlapped by the bottom edge portion of a like shingle in a next higher course of installed shingles.

Figure 2A:
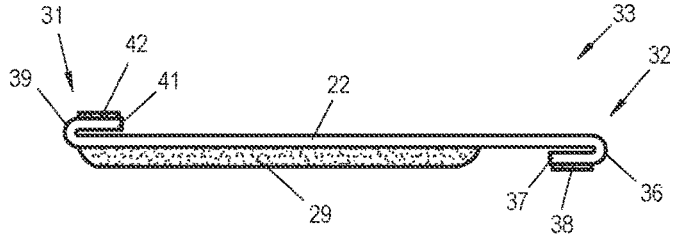
FIG. 2*a* is an elevational view of a metal roofing shingle illustrating one embodiment of side lap features according to the present disclosure.
Figure 2B:
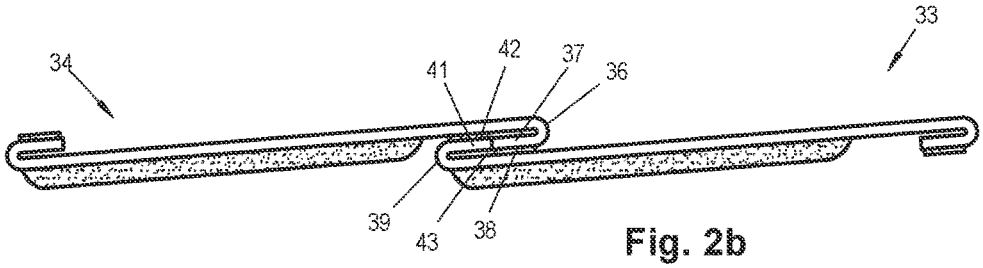
FIG. 2*b* is an elevational view of two like horizontally adjacent metal roofing shingles of FIG. 2*a* joined and sealed along their side lap features.

Side lap features, indicated generally as 31 and 32, and sealing features, indicated as 38 and 42 in FIGS. 2*a*-2*b*, extend along the side edges 26 and 27 of the single. Various embodiments of the side lap and sealing features will be described in more detail below. A self-seal strip 29 of adhesive sealant extends along the bottom of the shingle 21 in the portion that will overlap the headlap portion 28 of a like shingle in a next lower course of shingles. The adhesive sealant also may be applied on the top side of the shingle 21 along the headlap portion 28 or in both locations if desired.

In one or more of the embodiments detailed herein, the adhesive sealant may be applied as a bead, a strip, and/or as dots. The standard adhesive strip may range from ⅛ inch to ¾ inch in width and can vary in width depending on the application. A variety of Adhesive sealants can be used depending on application. Duragrip® brand adhesive available from GAF, as well as other adhesives used in a roofing headlap application can be used, as well as other more aggressive adhesives that tack at a colder temperature such as LORD® HM17-1 brand adhesive. The thickness of the adhesive sealant may range from 0.005 inch to 0.2 inch depending on the interlock configuration and position on the shingle. In some embodiments, the thickness of the adhesive sealant may range from 0.005 inch to 0.1 inch depending on the interlock configuration and position on the shingle. In some embodiments, the thickness of the adhesive sealant may range from 0.005 inch to 0.05 inch depending on the interlock configuration and position on the shingle. In some embodiments, the thickness of the adhesive sealant may range from 0.005 inch to 0.01 inch depending on the interlock configuration and position on the shingle. In some embodiments, the thickness of the adhesive sealant may range from 0.05 inch to 0.125 inch depending on the interlock configuration and position on the shingle. In some embodiments, the thickness of the adhesive sealant may range from 0.1 inch to 0.125 inch depending on the interlock configuration and position on the shingle.

In another embodiment, the sealant material may include a pressure sensitive adhesive. In other words, the sealant may include an adhesive that forms a bond when pressure is applied to the adhesive with a surface (e.g., when pressure is applied to one roofing shingle overlapping another roofing shingle). In yet another embodiment, the sealant material may include a bead, strip, or patterned arrangement of a pressure sensitive adhesive with a release material covering strip applied thereto. In such embodiments, prior to connecting two shingles, corresponding release material covering strips may be removed to expose the adhesive.

In embodiments, the thickness of the metal or other sheet material from which the shingles are made may range from 0.05 inch to 0.2 inch. In embodiments, the thickness of the metal or other sheet material from which the shingles are made may range from 0.1 inch to 0.2 inch. In embodiments, the thickness of the metal or other sheet material from which the shingles are made may range from 0.15 inch to 0.2 inch. In embodiments, the thickness of the metal or other sheet material from which the shingles are made may range from 0.17 inch to 0.2 inch. In embodiments, the thickness of the metal or other sheet material from which the shingles are made may range from 0.01 inch to 0.15 inch. In embodiments, the thickness of the metal or other sheet material from which the shingles are made may range from 0.01 inch to 0.12 inch. In embodiments, the thickness of the metal or other sheet material from which the shingles are made may range from 0.01 inch to 0.1 inch. In embodiments, the thickness of the metal or other sheet material from which the shingles are made may range from 0.01 inch to 0.05 inch. In embodiments, the thickness of the metal or other sheet material from which the shingles are made may range from 0.01 inch to 0.03 inch.

The remaining figures illustrate embodiments of side lap and sealing features 31-32 and 38 and 42 according to aspects of the present disclosure. In these figures, dimensions, and particularly thickness dimensions, are substantially exaggerated for clarity and ease of description.

FIGS. 2*a* and 2*b* show a metal shingle 33 with one embodiment of side lap features 31 and 32. Side lap feature 31 comprises a J-bend in the material of the shingle 33 resulting in an upwardly facing side lap feature with a bight 39 (which can include a curved or u-shaped section as illustrated, or can include other shaped sections configured to overlap and/or fit together) and a leg 41. A bead or strip of adhesive sealant 42 is applied along the top of the leg 41. Similarly, side lap feature 32 comprises a J-bend resulting in a downwardly facing side lap feature with a bight 36 and a leg 37. A bead or strip of adhesive sealant 38 is applied along the bottom of the leg 37. The bead or strip of headlap adhesive sealant 29 is visible along the bottom of the shingle 33 in the region that will overlap a shingle in a next lower course.

FIG. 2*b* shows two like shingles 33 and 34 with the side lap features of FIG. 2*a* as they appear when the shingles are installed in a side-by-side side lapped relationship on a substrate of a roof. The ends of legs 41 and 37 are seen to engage one another, which serves to properly align each of the two shingles 33 and 34. Adhesive sealant beads or strips 42 and 38 are captured between the legs 37, 41 of the J-bends and adjacent surfaces of the shingles 33, 34 to adhere the shingles 33, 34 together along the side lapped portions. In addition, the shingles can be positioned over and attached directly the substrate of the roof; and in some embodiments, an underlayment such as a thermoplastic polyolefin (TPO) membrane or other underlayment material can be applied between the substrate and the shingles.

Once heated by the sun on a roof, the adhesive sealant becomes partially malleable and cures to form a water tight seal against water incursion or penetration at the side lapped portions of the shingles. In this embodiment, the thickness of installed shingles along their side laps is approximately three times the thickness of the metal roofing shingle plus the relatively small thickness of each bead or strip of adhesive sealant.

Figure 3:
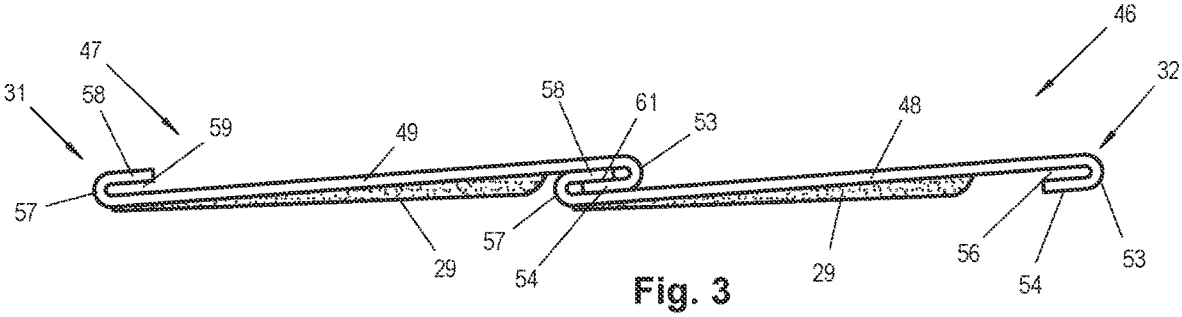
FIG. 3 is an elevational view of two horizontally adjacent metal roofing shingles illustrating another embodiment of side lap features joining and sealing the adjacent shingles.

FIG. 3 illustrates a variation of the embodiment of FIGS. 2*a* and 2*b* wherein the J-bends of the side lap features 31/32 of shingles 46 and 47 are formed to interlock with each other when one shingle is installed side-by-side with a like shingle in a course. Specifically, the J-bend of side lap feature 31 along the left edges of shingles 46 and 47 forms a bight 57, an upwardly facing leg 58, and a space 59 between the leg 58 and the shingle's top surface. The J-bend of side lap feature 32 along the right edges of shingles 46 and 47 forms a bight 53, a downwardly facing leg 54, and a space 56 between the leg 54 and the shingle's bottom surface. The main bodies of the shingles 46 and 47 are shown at 48 and 49.

When the two shingles 46 and 47 of FIG. 3 are joined side-by-side, the leg 58 of side lap feature 31 slides into the space 56 of side lap feature 32 to interlock the shingles 46, 47 together along their side lap and form a water tight junction. Adhesive sealant may be applied along the junction if desired to adhere and seal the shingles 46, 47 together. In this embodiment, the thickness along the side lap is three times the thickness of the metal of the shingle. In other embodiments, the thickness along the side lap is 1, 2, 3, 4, 5, 6, 7, 8, 9, or 10 times the thickness of the metal of the shingle. In this embodiment, the headlap adhesive sealant bead or strip 29 is seen in this example to be tapered across the width of the shingle. Such a configuration provides more adhesive in the regions of the side laps where one shingle is raised slightly above the roof deck relative to the other shingle. Further, such a configuration saves on manufacturing cost.

Figure 4:
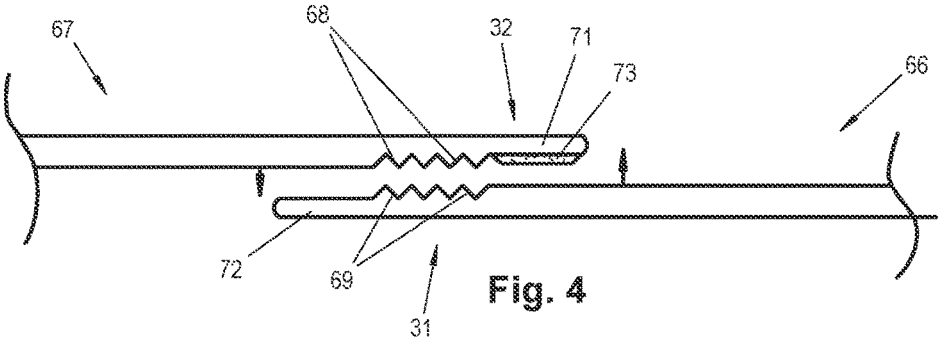
FIG. 4 is an elevational view of two horizontally adjacent metal roofing shingles illustrating yet another embodiment of side lap features for joining and sealing the adjacent shingles.

FIG. 4 illustrates another embodiment of side lap features 31 and 32. In this embodiment, the right side lap of like adjacent shingles 66 and 67 is machined or pressed or otherwise formed with downwardly facing saw tooth features 68 just inboard of a relatively thin tongue 71. The left side lap of shingles 66 and 67 are likewise formed with upwardly facing saw tooth features 69 just inboard of a relatively thin tongue 72. The saw tooth features 68 and 69 are offset so that when the side lap portions of two side-by-side shingles 66 and 67 are brought together as indicated by the arrows, the downwardly facing saw tooth features 68 intermesh with the upwardly facing saw tooth features 69 to align two like shingles 66 and 67 properly in the horizontal direction.

A bead or strip 73 of adhesive sealant is disposed along the bottom surface of the tongue 71 (or along the top surface of tongue 72, or both) to adhere the two shingles 66 and 67 together along their side lap and to seal against water incursion at the side lap. Further, the saw tooth features 68 and 69 reinforce the seal by collecting any water that may seep through the seal and directing the water to the forward edge of the shingle.

Figure 5A:
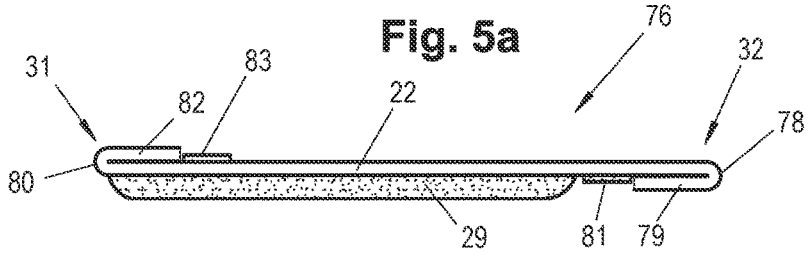
FIG. 5*a* is an elevational view of a metal roofing shingle illustrating another embodiment of side lap features for joining and sealing adjacent shingles according to the present disclosure.
Figure 5B:
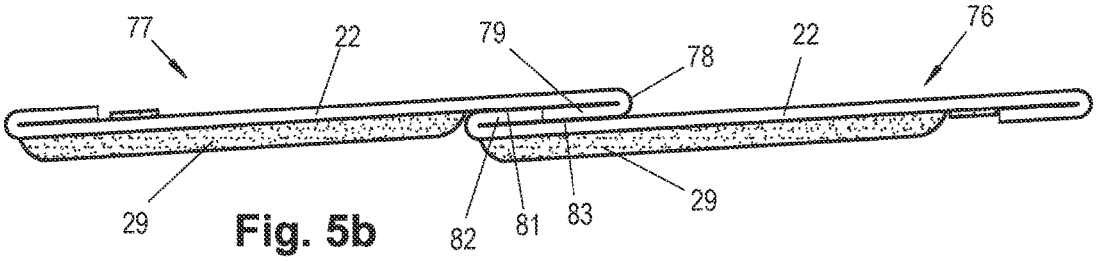
FIG. 5*b* is an elevational view of two horizontally adjacent metal roofing shingles of FIG. 5*a* joined and sealed together along their side lap features.

FIGS. 5*a* and 5*b* illustrate an embodiment of side lap features 31 and 32 similar to those of FIGS. 2*a* and 2*b*. As illustrated in FIG. 5*a*, the right side lap feature of shingle 76 comprises a J-shaped bend forming a bight 78 and a downwardly facing leg 79. The left side lap feature 31 of shingle 76 comprises a J-shaped bend forming a bight 80 and an upwardly facing leg 82. A bead or strip of adhesive sealant 81 extends along the bottom surface of the shingle 76 just inside the downwardly facing leg 79 and a bead or strip of adhesive sealant 83 extends along the top surface of the shingle 76 just inside the upwardly facing leg 82.

In FIG. 5*b*, two like shingles 76 and 77 are brought together in side lapped fashion with the ends of their legs 79 and 82 engaging one another to align the two shingles 76 and 77 properly with each other. The beads or strips of adhesive sealant 81 and 83 adhere the shingles 76 and 77 together and form water resistant seals along the side lapped portions of the shingles. One difference from the embodiment of FIGS. 2*a* and 2*b* is that the legs 79 and 82 of the J-shaped bends are significantly longer. In this embodiment, the legs 79 and 82 may be between one-half and three-quarters of an inch long, whereas in FIGS. 2*a* and 2*b*, the legs 37 and 41 may be shorter such as one-half inches long. In other embodiments, the legs may be between ¼ and 1 inch long. In yet other embodiments, the legs may be between ¼ and ½ inch long. In the embodiments shown in FIGS. 2*a* and 2*b*, the legs may be shorter, such as less than or equal to ½ inch long.

Figure 6:
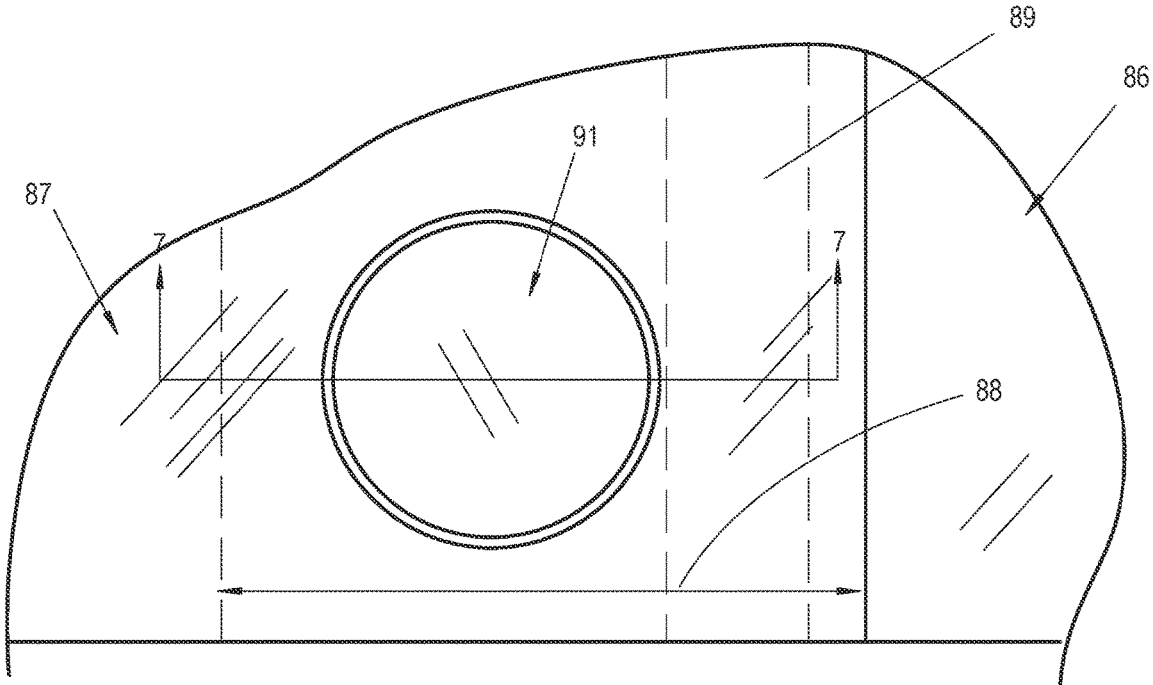
FIG. 6 is a partial top plan view of two horizontally adjacent metal roofing shingles overlapping and illustrating still another embodiment of side lap features for joining and sealing adjacent shingles according to the present disclosure.
Figure 7:
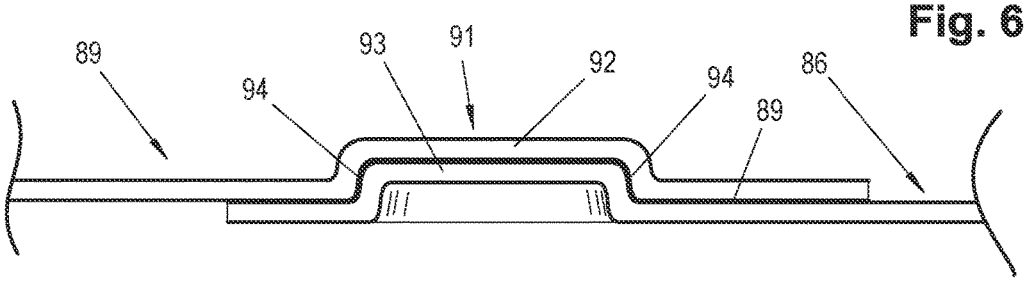
FIG. 7 is an elevational view taken along line 7-7 of FIG. 6 illustrating the interaction of the side lap features to align the shingles of FIG. 6 with each other.

FIG. 6 is a plan view of a portion of two like side lapped shingles 86 and 87 with alignment features comprising buttons 91 arrayed along the side laps. The buttons 91 are located within the side lapped regions 88 of the shingles 86 and 87 and a bead or strip of adhesive sealant 89 may be disposed between the overlapping side edge portions of the shingles 86 and 87 to adhere and form a seal. FIG. 7 is a cross sectional view taken along 7-7 of FIG. 6 showing the buttons 91 in more detail. Each button comprises a socket 92 formed in overlapping shingle 89 and a stud 93 formed in the overlapped shingle 86.

During installation, the sockets 92 of one shingle are pressed on the studs 93 of a side lapped shingle to align the two shingles horizontally. The studs 93 and sockets 92 may be configured so that they form an interference fit indicated at 94 to hold the shingles together as the adhesive sealant 89 cures. The adhesive sealant 89, when cured, adheres the shingles together and forms a seal. The thickness in the side lapped region of this embodiment is only twice the thickness of the material of the shingle.

Figure 8:
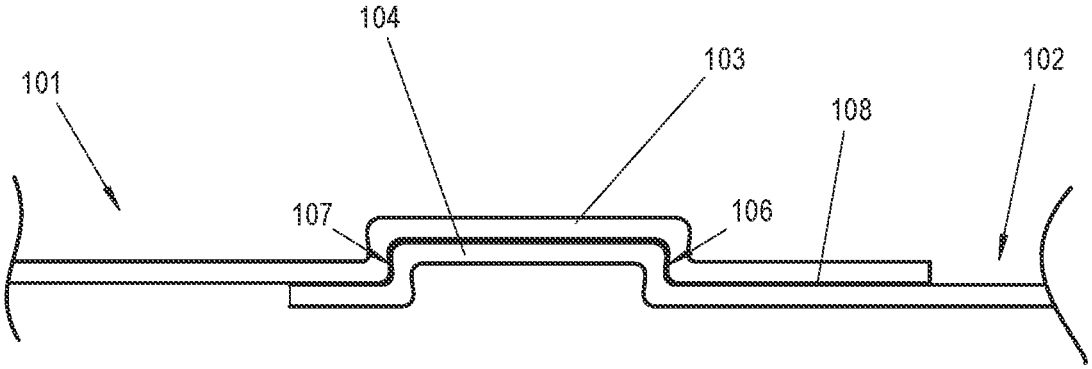
FIG. 8 is an elevational view of two horizontally side lapped metal shingles illustrating another embodiment of interlocking side lap features for joining and sealing adjacent shingles.

FIG. 8 illustrates an embodiment wherein the right edge portion of shingle 101 is formed with a cap 103 that extends completely along the side lap portion. The cap 103 has a slight inward draft angle along its interior sides. Like shingle 102 is formed along its left edge portion with a snap feature 104 extending completely along the side lap portion. The snap feature 104 has a slight inward draft angle along its exterior sides. When two side-by-side shingles are side lapped and pressed together along their side lapped edges, the cap 103 spreads slightly and snaps securely onto the snap feature 104. This forms a mechanical interlock indicated at 106, 107 that aligns the singles and holds them together in interlocked relationship. As with other embodiments, adhesive sealant 108 may be disposed between the side lapped portions to adhere and form a water resistant seal.

Figure 9:
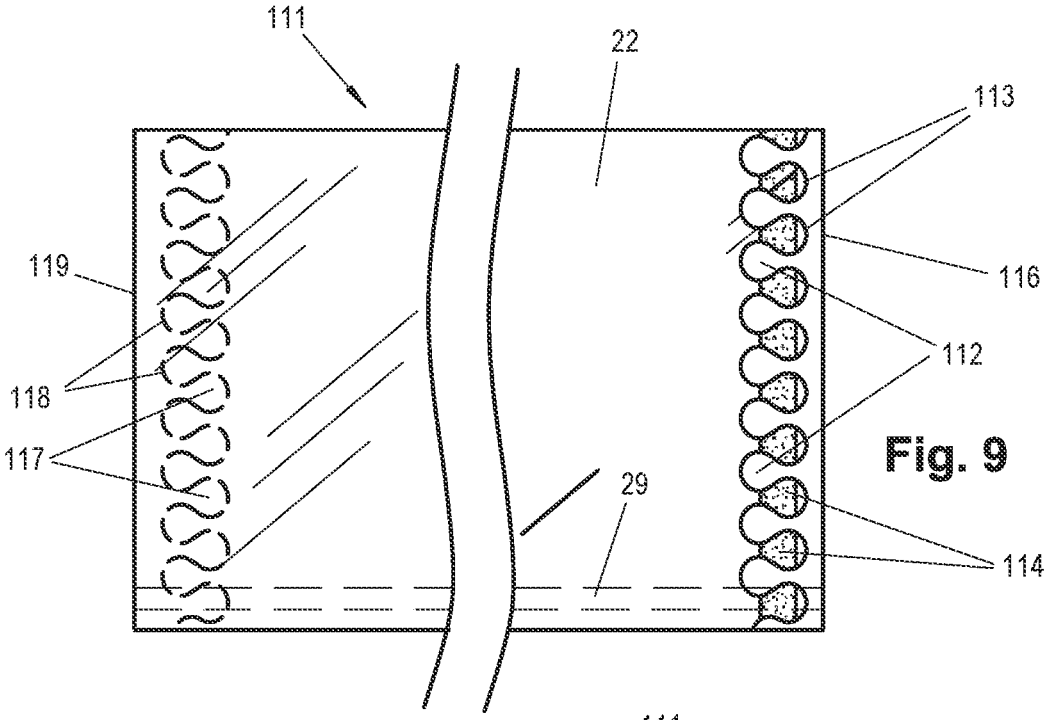
FIG. 9 is a top plan view of a metal roofing shingle illustrating an embodiment of interlocking side lap features for joining and sealing adjacent shingles according to aspects of the present disclosure.

FIG. 9 is a partial plan view of a shingle having side lap features according to another embodiment of the present disclosure. In this embodiment, the edges of a metal shingle are cut with a rotary die or otherwise to form an array of lobes and lobe sockets, sometimes referred to as lollipop features, along the edges. Each cut edge is then bent 180 degrees. In FIG. 9, the right edge of shingle 111 is bent up and over at bend 116 so that the lobes 112 and sockets 113 are disposed on the top side of the shingle 111. The left edge of like shingle 111 are bent at 119 down and under so that the lobes 117 and sockets 118 are disposed on the bottom side of the shingle 111.

A strip or bead of adhesive sealant 114 may be applied along one or both edges before bending so that the adhesive sealant 114 is exposed in the sockets between lobes of the array after bending. As with other embodiments, headlap sealant strip 29 is applied along the bottom of the shingle 111 to form a seal within headlap regions.

Figure 10A:
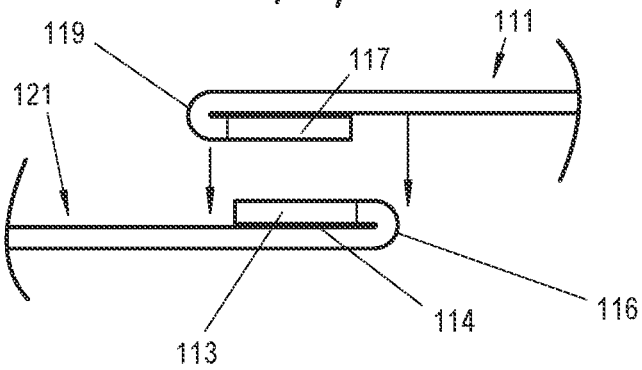
FIG. 10*a* is an elevational view of two like roofing shingles of FIG. 9 being interlocked during installation.
Figure 10B:
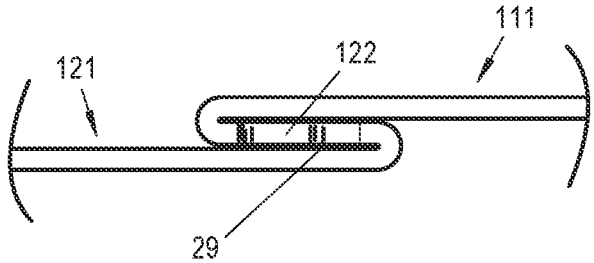
FIG. 10*b* is an elevational view of the two like roofing shingles of FIG. 10*a* interlocked and sealed together along their side lap features.

FIGS. 10*a* and 10*b* illustrate the process of installing two like metal shingles of FIG. 9 together in side lapped relationship. Specifically, the left edge portion of shingle 111 is moved downwardly onto the right edge portion of shingle 121 as indicated by the arrows. As the edge portions of the shingles 111 and 121 engage, the lobes 117 of shingle 111 are guided into the sockets 113 of like shingle 121 in interlocking fashion. The two side-by-side and side lapped shingles are thus mechanically interlocked and cannot move relative to each other in any in-plane direction. The adhesive sealant 114 eventually cures to adhere the shingles securely together and form a water barrier. FIG. 10*b* shows the side lapped, interlocked, and sealed shingles 111 and 121 after installation.

Figure 11A:
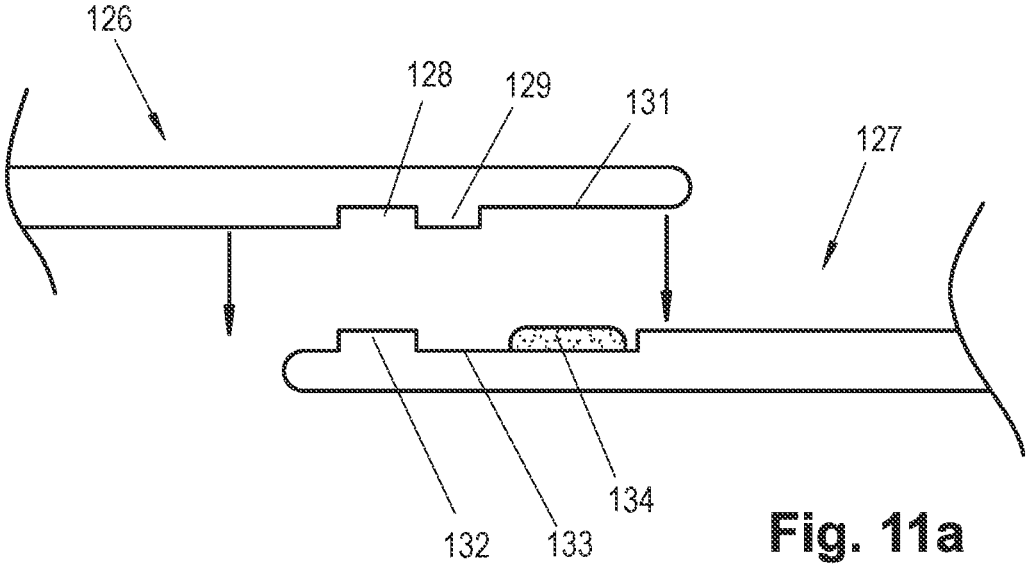
FIG. 11*a* is an elevational view of another embodiment of two like roofing shingles of having side lap features for joining and sealing adjacent shingles being interlocked during installation.
Figure 11B:
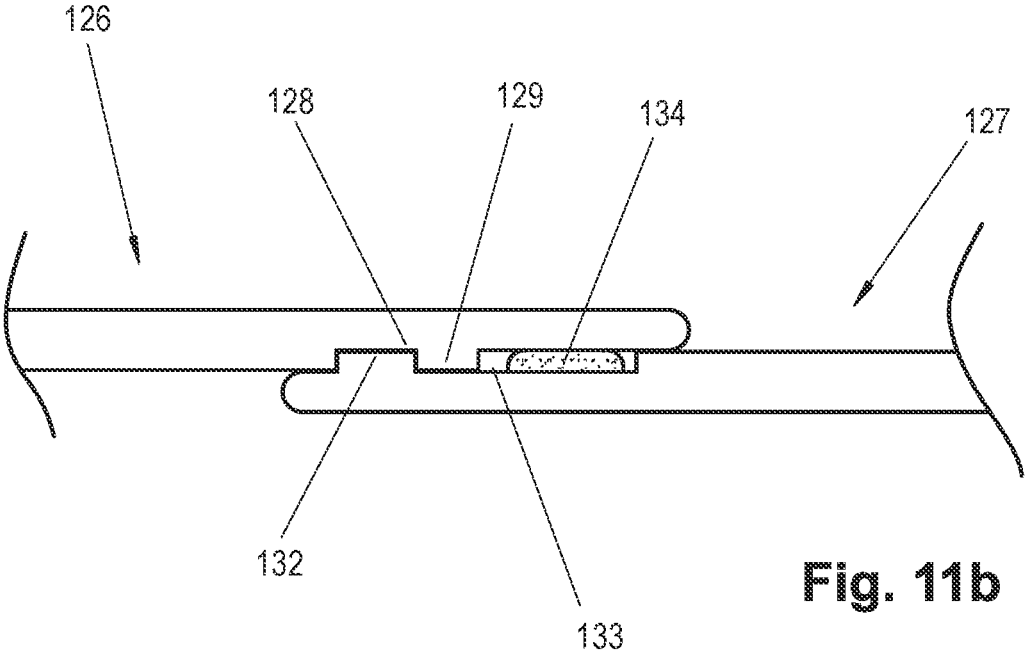
FIG. 11*b* is an elevational view of the two like metal roofing shingles of FIG. 11*a* interlocked and sealed together along their side lap features.

FIGS. 11*a* and 11*b* show yet another embodiment of side lap features on two like shingles 126 and 127. In this embodiment, the right side edge of shingle 126 is machined, pressed, or otherwise formed to define a long downwardly facing groove 128 bordered by a downwardly extending tongue 129. A lip 131 extends from the tongue 129 to the right edge of the shingle 126. The left side edge of like shingle 127 is machined, pressed, or otherwise formed to define an upwardly facing tongue 132 sized to fit into groove 128 and a recessed adhesive chamber 133 inboard of the groove 132. A bead or strip of adhesive sealant 134 may be disposed in the adhesive chamber 133 as shown.

FIG. 11*b* shows opposite edges of like shingles 126 and 127 pressed together in side lapped fashion. Tongue 132 is engaged within groove 128 to align the shingles 126 and 127 properly with each other horizontally. The lip 131 overlies and covers the adhesive chamber 133 and the adhesive sealant 134 is compressed between the floor of the adhesive chamber 133 and the lip 131. As shingles of an installation are heated by the sun, the adhesive sealant cures to adhere side lapped shingles securely together and form a barrier against water intrusion or penetration at side laps. One advantage of this embodiment is that the total thickness along the side laps of adjacent shingles is less than twice the thickness of the metal shingle itself.

Figure 12:
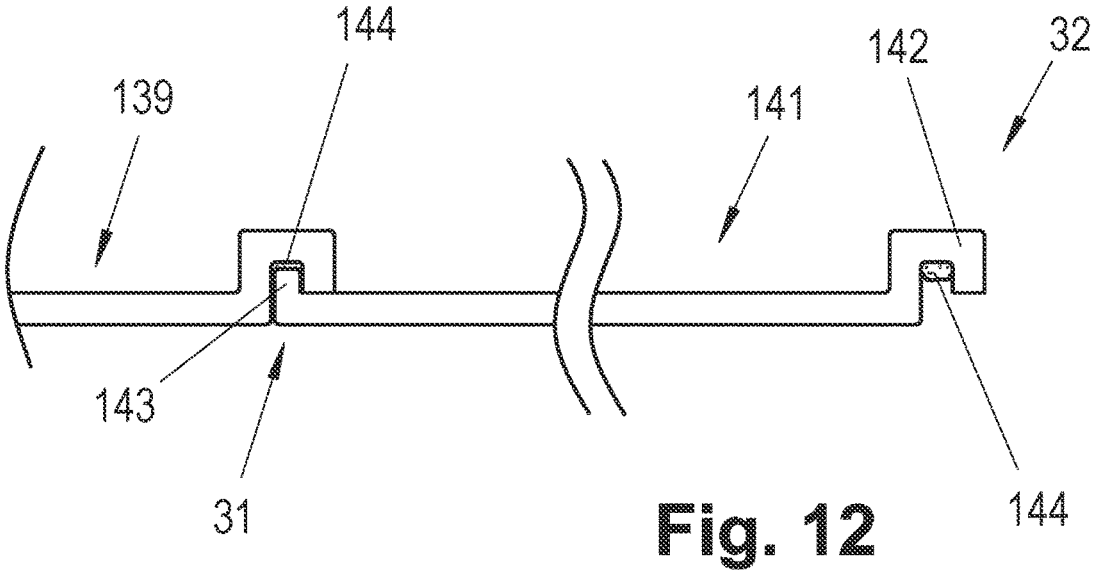
FIG. 12 is an elevational view from the bottom edges of two like horizontally adjacent side lapped metal shingles illustrating another embodiment of interlocking side lap features for joining and sealing adjacent shingles.

FIG. 12 illustrates an alternate embodiment of like shingles 139 and 141 with side lap features that form a miniature "standing seam" configuration between horizontally adjacent shingles. Here, the left side edge of shingle 141 has a side lap feature 31 in the form of an upstanding ridge 143. The right side edge of like shingle 141 has a side lap feature 32 in the form of a ridge cover 142 with a downwardly facing groove bearing a bead 144 of adhesive sealant. As shown on the left in FIG. 12, when two like shingles 139 and 141 are side lapped and pressed together, the upstanding ridge 143 of one shingle slides into the downwardly facing groove of the ridge cover 142 of the other shingle. In the process, the adhesive sealant bead 144 is compressed and fills the space between the upstanding ridge 143 and the downwardly facing groove of the ridge cover 142 to bond the two shingles together along their side lap. When cured by the heat of the sun, the adhesive sealant also forms a water tight seal or barrier along the side lap.

An advantage of the embodiment of FIG. 12 is that the bottom surfaces of side lapped shingles are co-planer with each other, thus enhancing appearance in the view of some and increasing the efficiency of headlap adhesive sealant.

Figure 13:
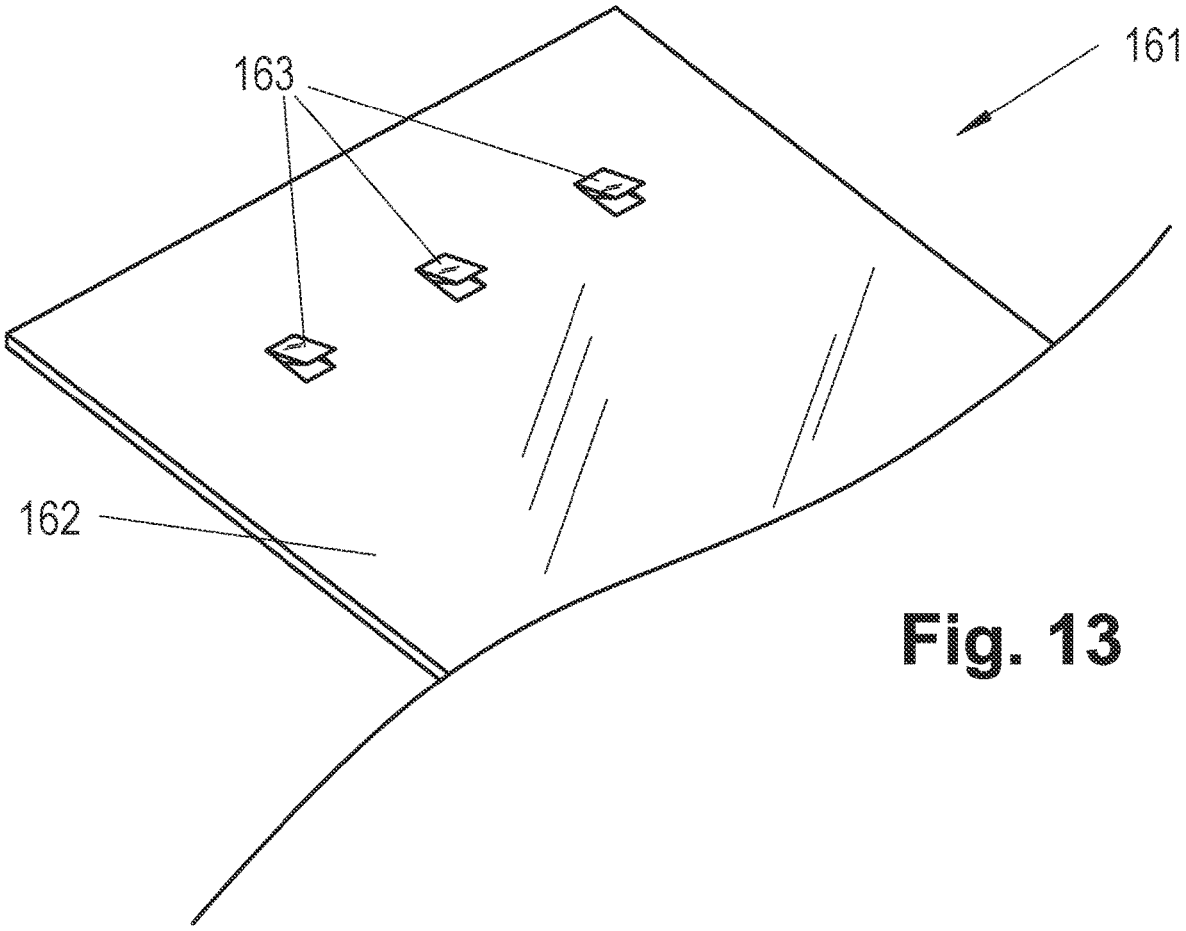
FIG. 13 is an isometric view of a metal shingle illustrating another embodiment of interlocking side lap features for joining and sealing adjacent shingles.
Figure 14A:
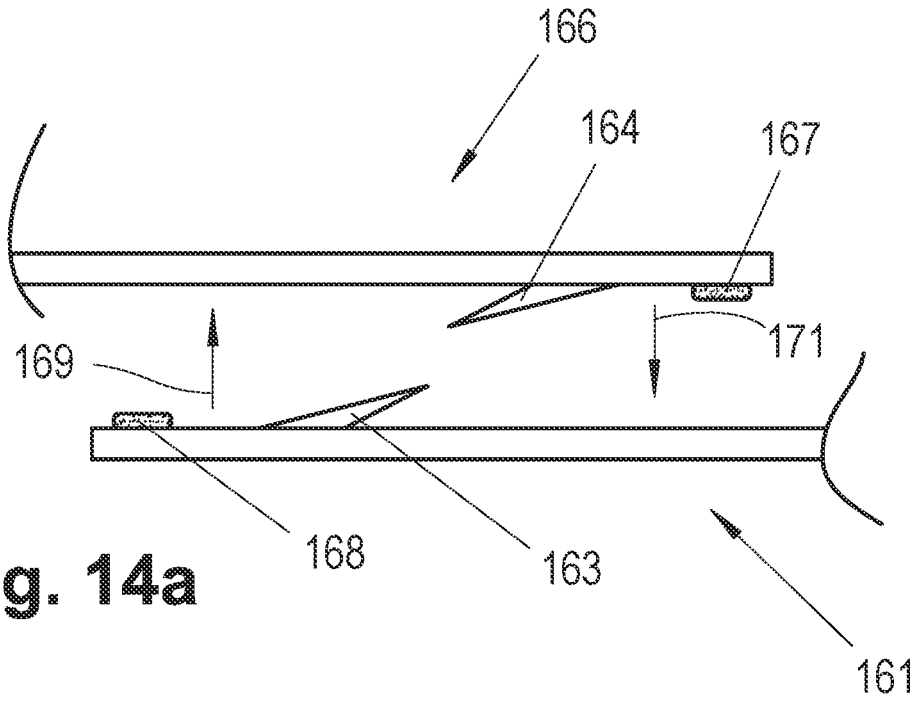
FIG. 14*a* is an elevational view of two like metal roofing shingles of FIG. 13 being installed in side lapped configuration.
Figure 14B:
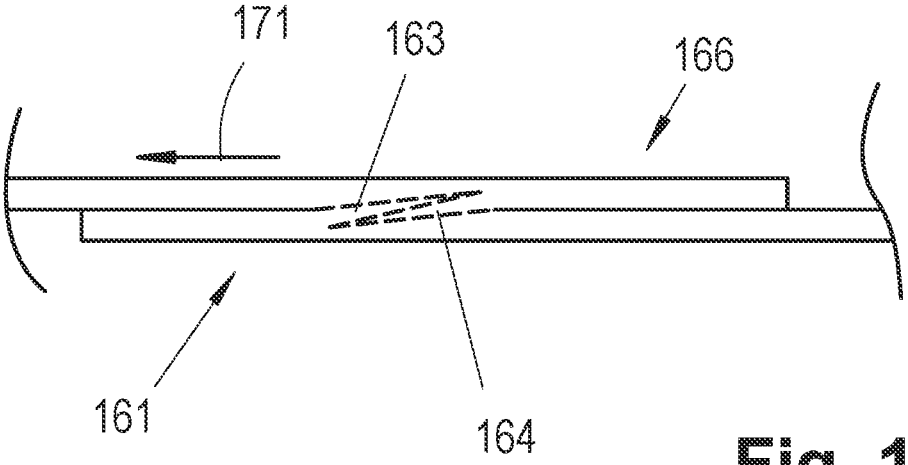
FIG. 14*b* is an elevational view from the bottom edges of two like metal roofing shingles of FIG. 13 installed, interlocked, and sealed at their side lap features.

FIGS. 13-14*b* illustrate yet another embodiment of side lap alignment features according to the present disclosure. Referring to FIG. 13, a metal shingle 161 has a body panel 162. Upstanding hooks 163 (3 in this case) are formed in the surface of the panel by a gouging process and extend in a line adjacent one side edge of the shingle 161. While not visible in FIG. 13, hooks 164 (FIG. 14*a*) also are gouged into the opposite surface of the panel adjacent the other side edge of the shingle. The hooks may range in width from ⅛ inch to ¼ inch.

In FIG. 14*a*, shingle 161 with gouged hooks 163 and like shingle 166 with gouged hooks 164 are shown by arrows 169 and 171 being brought together in side lapped relationship. Hooks 161 and 163 are in opposing alignment as the shingles are brought together. Adhesive sealant beads or strips 167 and 168 are disposed along the side edges of the shingles outboard of the hooks 163 and 164 to adhere the shingles together and form a seal against water incursion or penetration.

In FIG. 14*b*, the two shingles 161 and 166 have been brought into contact. To interlock the shingles 161 and 166 together and align them in the horizontal direction, the overlapping shingle 166 is slid relative to the underlying shingle 161 in the direction indicated by arrow 171. This causes the two sets of gouged hooks 163 and 164 to engage with each other as shown in dashed lines in FIG. 14*b*. Then, downward pressure exerted on the side lapped regions of the shingle 161 and 166 causes the hooks 163 and 164 to flatten and interlock securely with each other. At the same time, the adhesive sealant 167 and 168 bonds the shingles 161 and 166 together along the side lap and forms seals against water incursion or penetration.

One advantage of the embodiment of FIGS. 13-14*b* is that the total thickness along the side lapped regions of adjacent shingles is only twice the thickness of the metal or other sheet material of the shingles themselves, thus retaining a substantially flat appearance.

Figure 15:
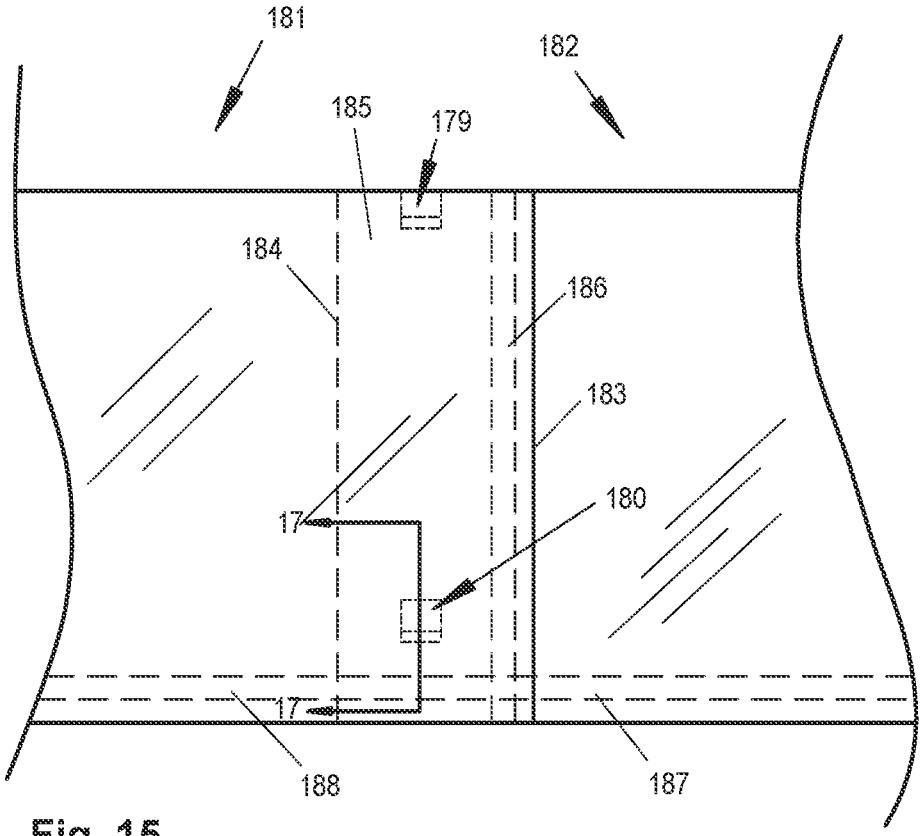
FIG. 15 is a top plan view of two side lapped metal roofing shingles illustrating still another embodiment of the present disclosure.

FIG. 15 illustrates another embodiment of the present disclosure. Here, the right edge of a metal shingle 181 is overlapped onto the left edge of a like shingle 182 forming a side lapped region 185. The rightmost edge 183 of the left shingle 181 is visible in this plan view and the leftmost edge 184 of like shingle 182 is hidden below the right edge of shingle 181. A bead or strip of adhesive sealant 186 is disposed between the side lapped shingles 181 and 182 to adhere the shingles 181 and 182 and form a seal along the side lap. Beads or strips of adhesive sealant 187 and 188 are disposed on the backs surfaces of shingles 181 and 182 and extend generally along the bottom edges of the shingles 181 and 182. These beads or strips of adhesive sealant 187 and 188 bond the lower edges of shingles in one course to the headlap portion of shingles in a next lower course. Interlocking and alignment features 179 and 180, described in more detail below, are illustrated in dashed lines in FIG. 15.

Figure 16:
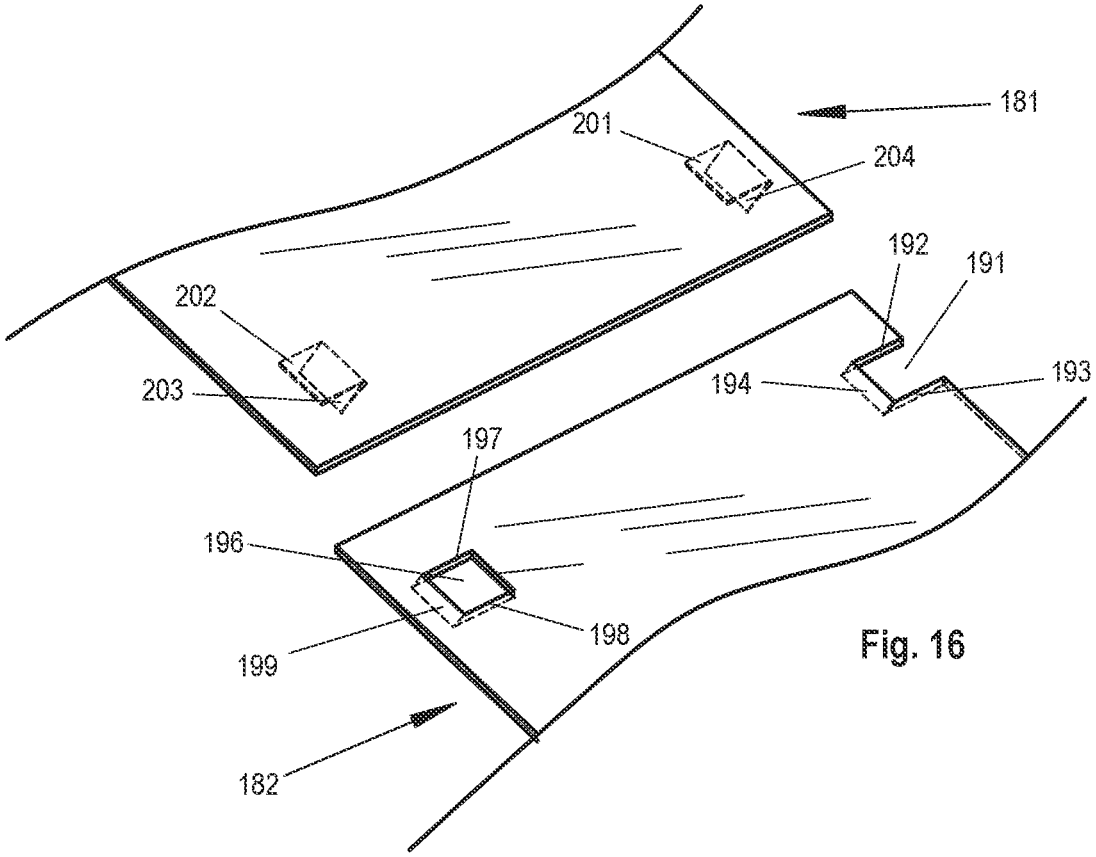
FIG. 16 is an isometric view showing the two metal roofing shingles of FIG. 15 separated and showing the interlocking alignment features of this embodiment.

FIG. 16 shows the two like shingles 181 and 182 separated and illustrates the interlocking and alignment features more clearly. The left edge portions of the shingles are formed with an upper slot 191 defined between side walls 192 and 193 and a forward wall 194. The forward wall 194 is angled downwardly and forwardly for purposes discussed below. A lower slot 196 is formed adjacent the lower edge of the shingle and is defined between side walls 197 and 198, a rear wall, and a forward wall 199. As with the upper slot 191, the forward wall 199 of slot 196 is angled downwardly and forwardly.

With continued reference to FIG. 16, the right edge portions of the shingles are formed on their bottom surfaces with two downwardly and forwardly extending hooks 204 and 203. The hooks 204 and 203 in this embodiment are formed in the metal of the shingle by a gouging process wherein the hooks 204 and 203 are gouged out of the bottom surface of the shingle leaving gouges 201 and 202. The hooks 204 and 203 may, of course, be formed in other appropriate ways or they may be separate elements that are attached to the shingles by an appropriate means such as welding.

During installation, the right edge portion of shingle 181 is side lapped onto the left edge portion of like shingle 182 such that it is somewhat upwardly displaced and misaligned with shingle 182. Shingle 181 is then slid or forced forward. As the shingle 181 moves forwardly, its hooks 204 and 203 engage within the slots 191 and 196 in the left end portion of shingle 182. This both aligns the two shingles with each other horizontally and interlocks the shingles together.

Figure 17:
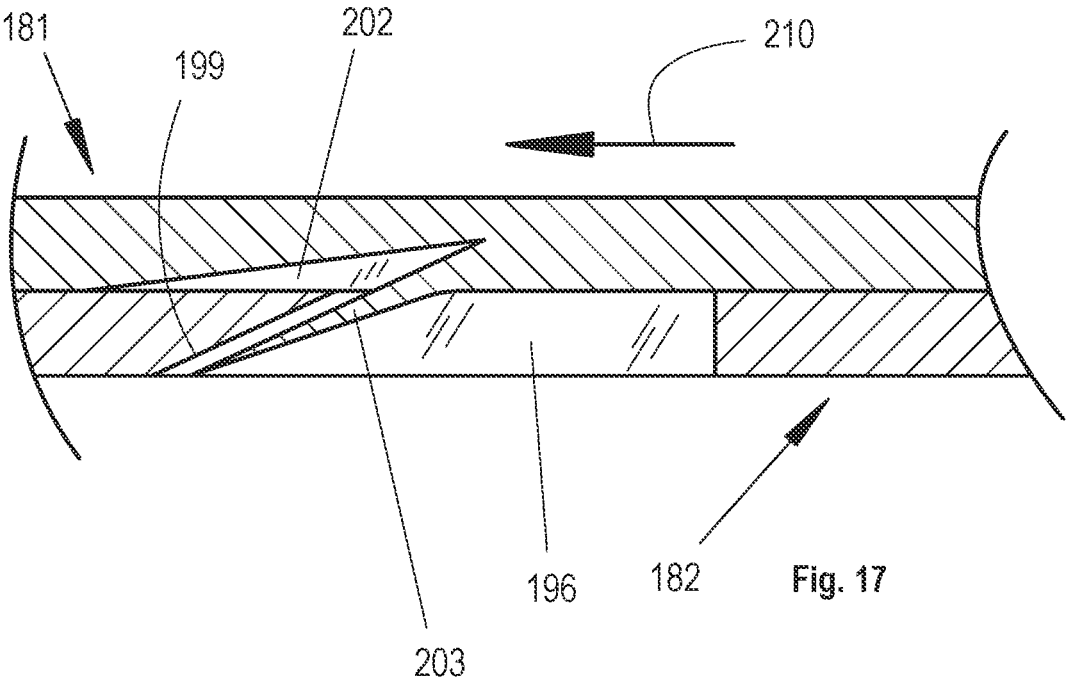
FIG. 17 is a cross sectional view taken along line 17-17 of FIG. 15 illustrating the interaction of the interlocking alignment features to align to side lapped metal roofing shingles.

The interlocking and alignment function is illustrated in more detail in FIG. 17. Shingle 181 is shown side lapped onto shingle 182 and moving in a forward direction 210. The hook 203 formed from the gouge 202 has dropped into the slot 196. As a result of the gouging process, the hook extends downwardly and forwardly from the bottom surface of shingle 181. The angle of the forward wall 199 of the slot 196 is generally similar to the angle of the gouged out hook 203. When the hook 203 engages the forward wall 199, the movement of shingle 181 is arrested and the two like shingles 181 and 182 are properly aligned with each other. Furthermore, due at least in part to the angle of the hook 203 and the forward wall 199, the two shingles are interlocked together along the side lap both at the top and bottom portions of the side lap.

Figure 18:
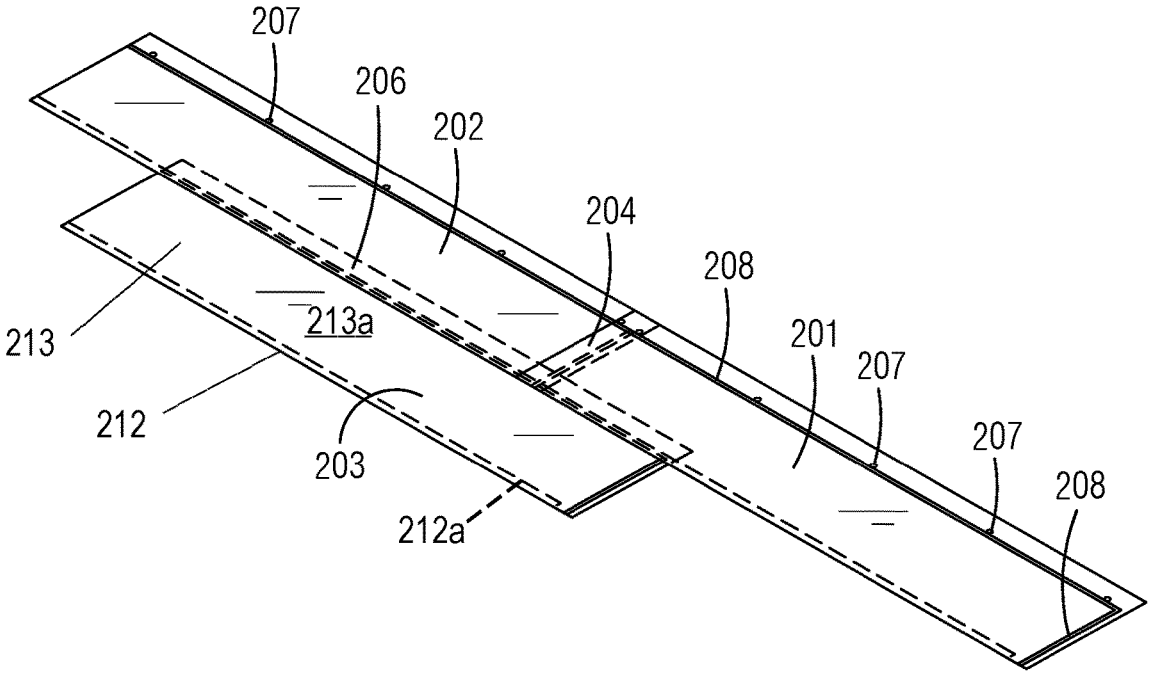
FIG. 18 is an isometric view showing two side lapped metal roofing shingles in an upper course overlapping a metal roofing shingle in a lower course along a headlap region with the metal roofing shingles being aligned and sealed along side lap and headlap regions according to principles of the present disclosure.
Figure 19A:
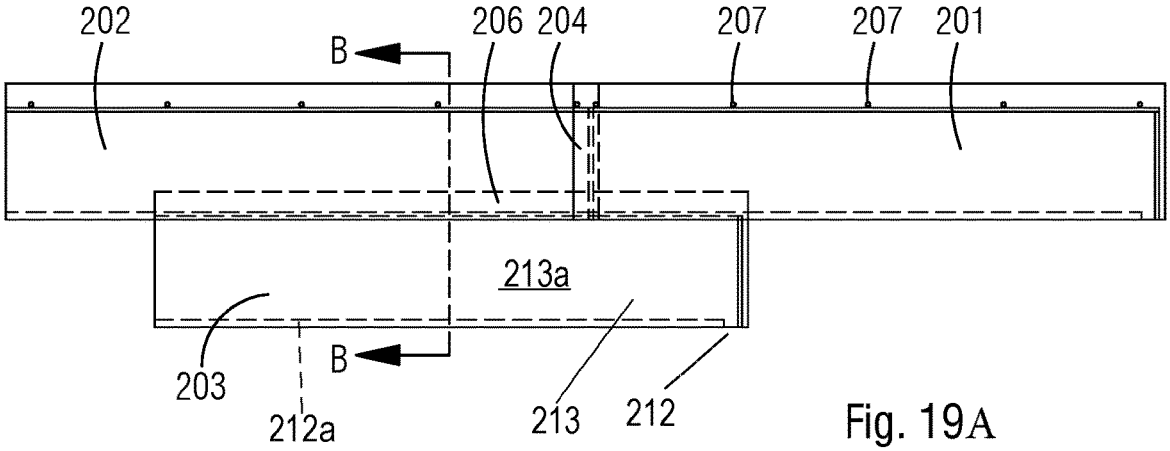
FIG. 19 is a top plan view of the metal roofing shingles shown in FIG. 18 showing the regions of overlap.

FIGS. 18 and 19 are two views of an additional embodiment or arrangement of metal shingles and will be described together. Two metal shingles 201 and 202 are arranged side-by-side in an upper course of shingles. These shingles overlap and are sealed at their ends at side lap regions 204 according to principles of the incorporated provisional applications. A metal shingle 203 in a next lower course of shingles is seen overlapped by the metal shingles 201 and 202 along a headlap region 206. Headlap alignment features 207, described in more detail below, are arrayed along the top edges of the shingles within the headlap region. Beads or strips of sealant 208 extend around the top edges of each shingle within the headlap region and along one of the side edges of each shingle within the side lap portion.

Figure 20:
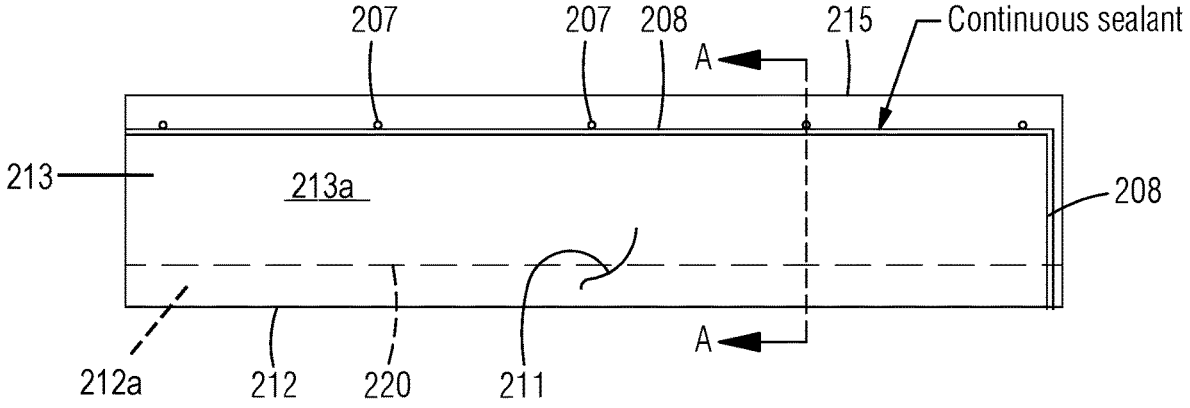
FIG. 20 is a top plan view of a single metal shingle illustrating headlap alignment and sealing features according to principles of the present disclosure.

FIG. 20 shows a single metal shingle 211 according to principles of the present disclosure. The metal shingle 211 has a body 213, a top edge 215 and an opposed bottom edge 212, with a main body portion 213*a* defined between the bottom edge 212 and the headlap alignment features 207. The bottom edge is defined by a bend 212*a* in the material of the shingle resulting in an underlying tab 220. The underlying tab 220 has a terminal edge 225 that may be spaced slightly away from the bottom of the shingle 211. The bend 212*a* and underlying tab 220 with its terminal edge 225 are better illustrated in FIG. 21, which is a cross section along line A-A of FIG. 20.

Figure 21:
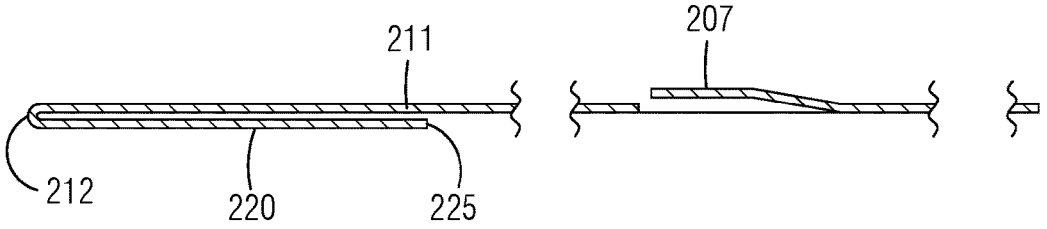
FIG. 21 is a cross sectional view taken along line A-A of FIG. 20 showing details of headlap alignment features according to principles of the present disclosure.
Figure 22:
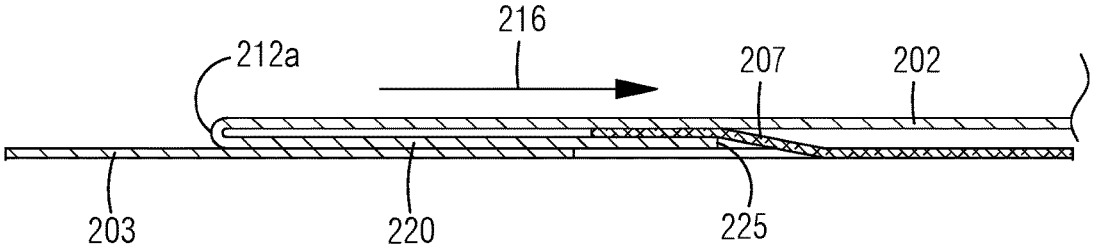
FIG. 22 is a cross sectional view taken along line B-B of FIG. 18 showing engagement of the headlap alignment features to align shingles in one course with overlapped shingles in a next lower course.

Line A-A extends through one of the headlap alignment features 207. As shown in FIG. 21, the headlap alignment features 207 in this embodiment comprise tabs that are punched out of the material of the metal shingle and bent upwardly to that the tabs stand proud of the top surface of the shingle. These tabs in cooperation with an underlying tab 220 of a shingle in a next lower course align the two shingles properly along their headlap portions. More specifically, as illustrated in FIG. 22, with a shingle 203 in a lower course previously installed, a shingle 202 in a next higher course is laid onto shingle 203 and slid upward as indicated by arrow 216.

As the shingle 202 slides upward, the terminal edge 225 of its underlying tab 220 engages and slides beneath the headlap alignment features 207, which in this embodiment are raised tabs. When the terminal edge 225 is fully engaged beneath the tabs, then the overlying shingle 202 is properly aligned with the underlying shingle 203 along their headlap regions. The sealant 208 (FIG. 20) then bonds the two shingles together and forms a seal against migration of water through the headlap regions of the shingles. Installation continues with each higher course until a roof is shingled with metal shingles.

Figure 23A:
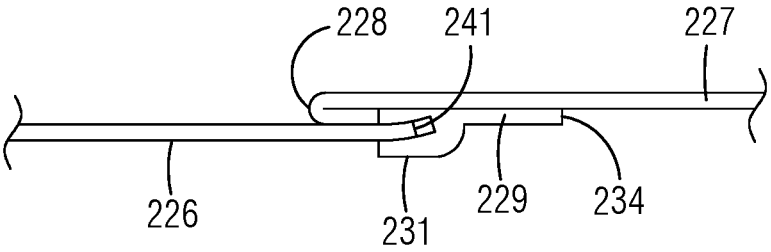
FIGS. 23*a*-23*c* are a side elevational view, a top plan view, and a bottom plan view of two metal shingles aligned along their headlap regions using another embodiment of headlap alignment features according to principles of the present disclosure.

FIGS. 23*a* through 23*c* and FIG. 24 illustrate another embodiment of headlap alignment features according to the present disclosure. In this embodiment, shingles in one course are slid downwardly over the upper edges of shingles in a next lower course for installation. Referring to FIG. 23*a* a metal shingle 227 in one course has a forward edge formed by a bend 228 in the material of the shingle. The bend 228 results in an underlying tab 229 with a terminal edge 234 beneath the shingle. Alignment features 231 are punched out of the underlying tab 229 and are bent downwardly forming hooks beneath the forward edge of shingle 227.

Shingle 226 in a next lower course has a rear edge portion 241. This portion may be formed with upwardly bent tabs 242 (FIG. 24) that align with the hooks when a shingle in one course is slid down onto a shingle of a next lower course. Alternatively, the entire rear edge portion of the shingle in the next lower course may be bent up slightly to form a continuous tab. In any event, the hooks 231 form alignment features that engage with the rear edge portion 241 of a next lower shingle to align the shingles along their headlap portions.

Figure 23B:
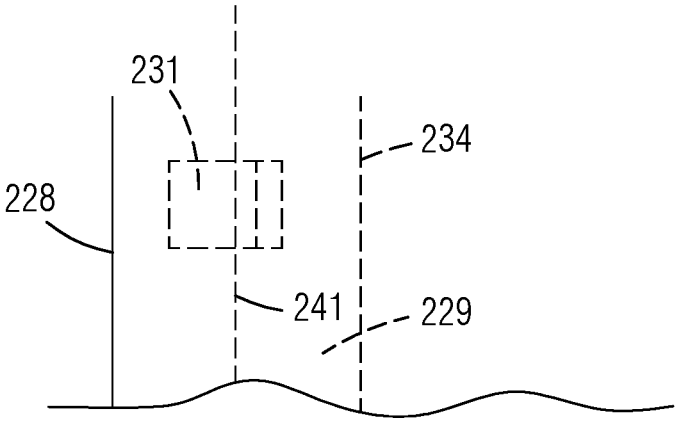
Figure 23C:
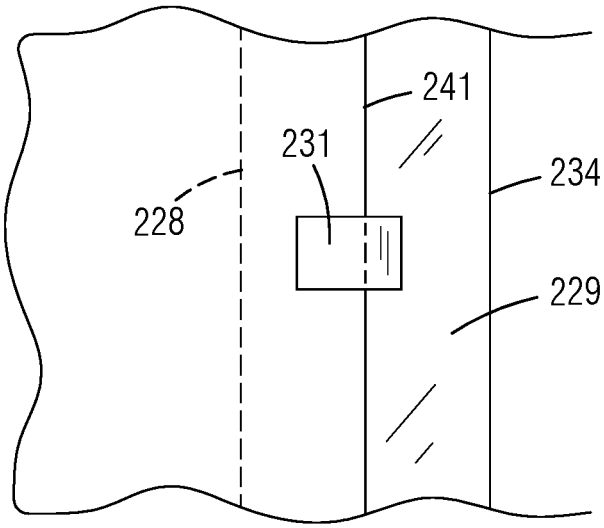

FIG. 23*b* is a top view of the overlapped shingles of 23*a* showing in phantom lines the rear edge 241 of a lower shingle engaged with a hook 231 of a next higher shingle, all beneath the surface of the upper shingle. FIG. 23*c* is a view of the same arrangement as seen from the bottom wherein one of the hooks 231 and the rear edge 234 of the underlying tab 229.

Figure 24:
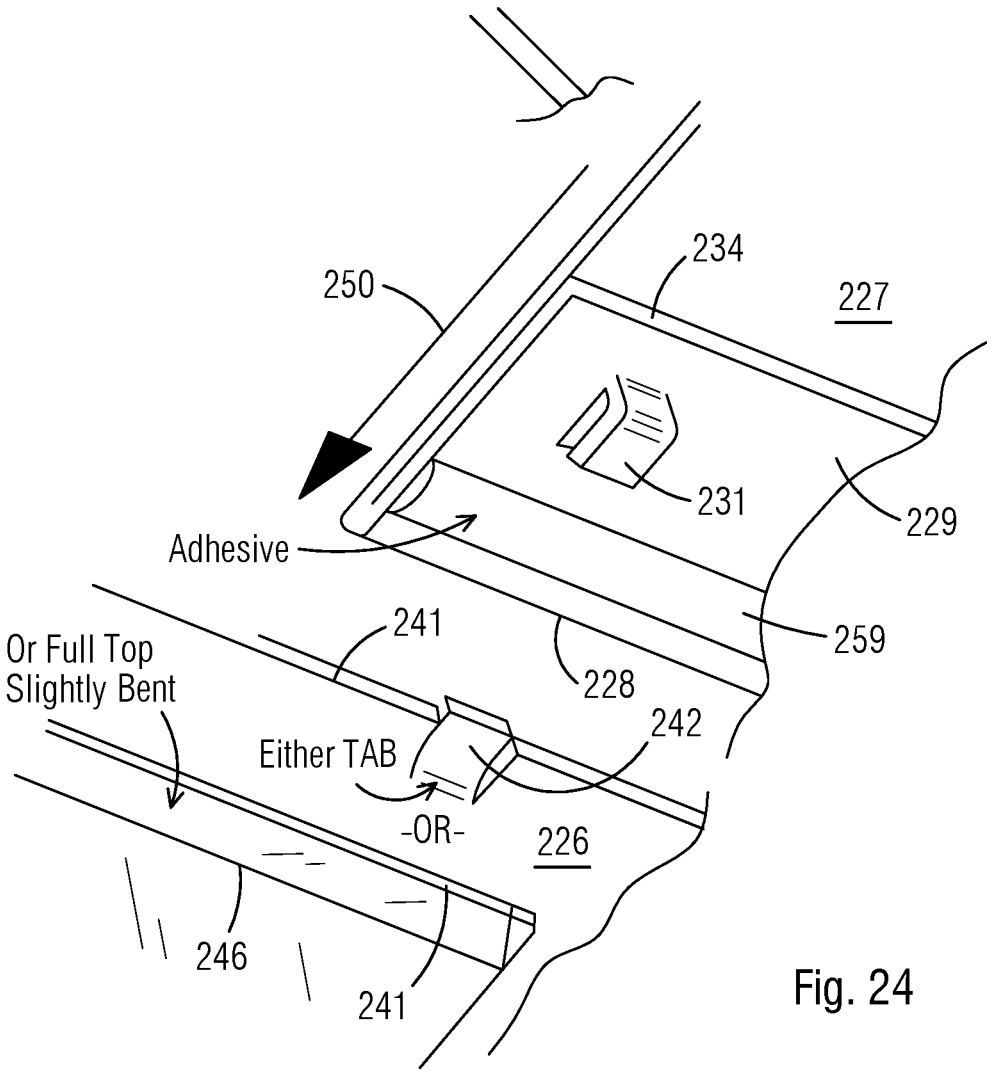
FIG. 24 is an isometric view from the bottoms of two shingles showing in more detail the headlap alignment features illustrated in FIGS. 23*a*-23*c*.

FIG. 24 is an isometric view from the bottom showing the just described alignment features in more detail. The underlying tab 229 formed by the bend 228 is shown as is it rear edge 234. Downward hooks 231 are shown punched from the material of the underlying tab and a bead or strip of sealant 259 extends just inside the forward edge 228 of the overlying shingle. FIG. 24 also shows two alternative embodiments wherein upwardly bent tabs 242 may be formed along the rear edges of shingles to engage with the hooks 231. Alternatively, the entire rear edges of shingles may be bent up slightly to engage the hooks as shown at the lower left portion of FIG. 24.

Figure 25:
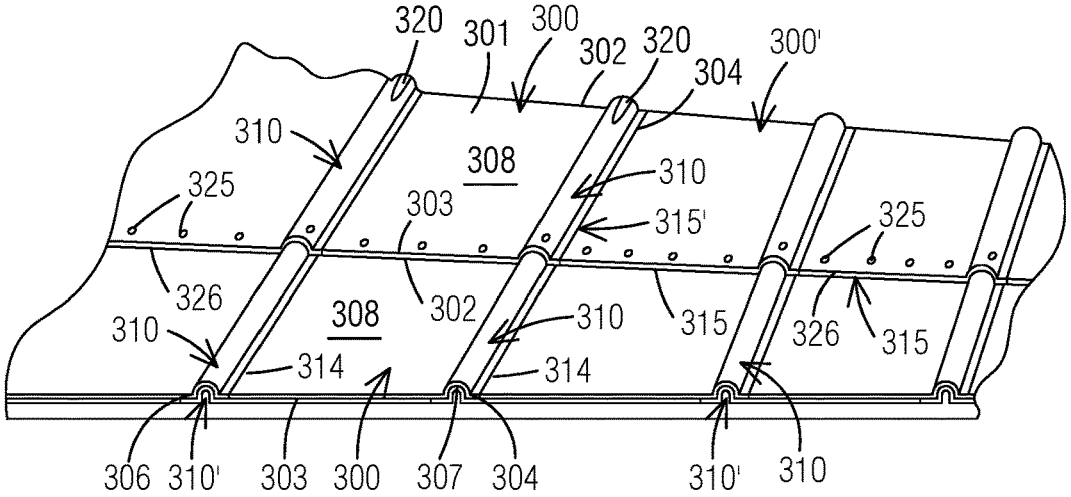
FIG. 25 is a perspective view of another embodiment of a roofing system with metal roofing shingles according to the principles of the present disclosure.

FIG. 25 illustrates another embodiment of metal roofing shingles 300 that can be interlocked or inter-connected across a roofing substrate or deck for forming a roof structure or system in accordance for the principles of the present disclosure. In some embodiments, the metal roofing shingles can be positioned directly over the substrate, while in other embodiments, an underlayment such as a TPO membrane can be applied to the substrate with the metal roofing shingles positioned over the underlayment. The roofing metal roofing shingles 300 are shown in the embodiment of FIG. 25 as metal roofing shingles, though it will be understood that various other materials, including polymer and other materials, as well as combinations of polymer and/or metal materials also can be used. The roofing shingles 300 further are shown as having a generally rectangular shape in FIG. 25, with each roofing shingle 300 having a body 301 including a top edge 302, a bottom edge 303, a right side edge 304, and a left side edge 306. The body 301 further will have a lower facing surface 307 and an exterior surface or exposed surface 308, adapted to be exposed to the elements when the roofing shingle installed as part of the roof structure. It will also be understood that other shapes or configurations can be provided.

Side lap portions or features 310 generally will be formed and extend along one or more side edges of the roofing shingles 300. As further illustrated in FIGS. 25-26*b*, the side lap portions 310 can be formed with and/or will define interlocking features configured to fit over and engage/interlock with a corresponding side lap portion 310 of a laterally or horizontally adjacent/next roofing shingle 300'. The interlocking features defined by the side lap portions can be configured in various shapes or configurations, for example, as generally illustrated in FIGS. 27*a* and 27*b*, having a generally arched, domed or rounded configuration, whereby the side lap portion of a first roofing shingle can overlie and can be coupled to a corresponding side lap portion of a second, laterally or horizontally adjacent roofing shingle, as shown in FIG. 25.

Figure 26A:
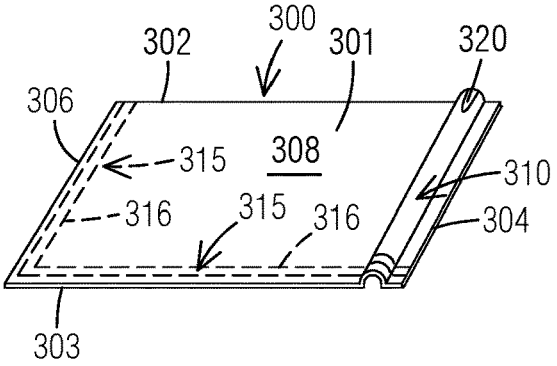
FIGS. 26*a*-26*c* are isometric views of one or more the metal roofing shingles according to the embodiment illustrated in FIG. 25.
Figure 27A:
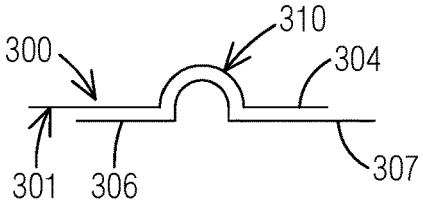
FIGS. 27*a* and 27*b* are end views of embodiments of overlapping connections between adjacent metal roofing shingles illustrated in FIGS. 25-26*c*.
Figure 27B:
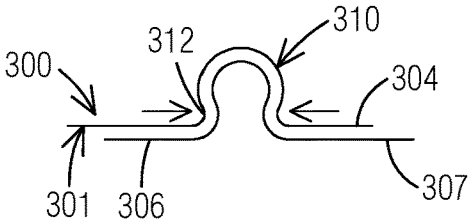

As further illustrated in FIG. 26*a*, adhesive materials 315 can be applied along one or both of the side edges 304/306, and/or along one or both of the top and bottom edges 302/303 each roofing shingle. The adhesive sealant materials will be applied to the lower or bottom facing surface 307 of each roofing shingle, and can include a self-sealing strip of an adhesive sealant (shown in dashed lines 316) that can extend along the side and top and/or bottom edges of each roofing shingle. Alternatively, the adhesive materials can include sealants or other, similar materials that can be applied to the roofing shingle in the field by an installer. In addition, in one or more embodiments, as discussed above, the adhesive material may be applied as a bead, strip and/or as dots, or in another pattern, and can be applied in various widths depending on the application of the roofing shingles. During installation of the roofing shingles 300, the adhesive material can be exposed or applied along the bottom surface of the roofing shingles, and/or can be applied to the roofing substrate or deck, to attach and seal one or more of the side, top and bottom edges of the roofing shingle to the roofing substrate or deck.

Figure 26B:
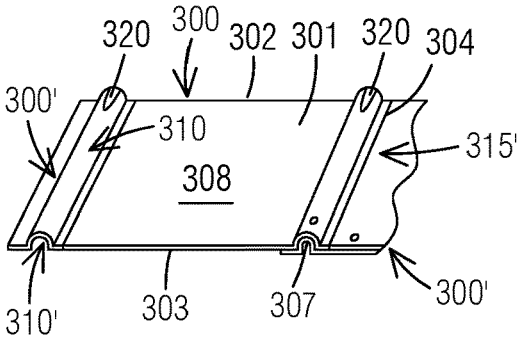
Figure 26C:
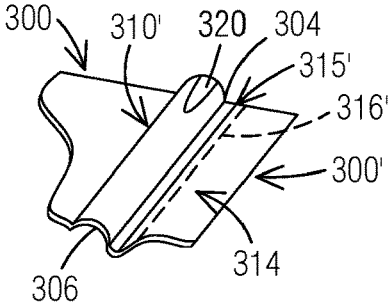

In some embodiments, the roofing shingles 300 further can include a slot or cut-out 320, as illustrated in FIGS. 26*a* and 26*c*. This slot or cut-out 320 generally can be formed along at least one end of at least one side lap portion 310 of each roofing shingle 300, and will be configured to cause an expansion of the arched or rounded/domed side lap portions 310, resulting in a resilient biasing or compression force applied along the lower portions. For example, as shown in FIG. 27*b*, the sides/legs 312 or lower portions of the side lap portions 310 can be tapered or biased inwardly to provide a substantially snap-fitting, compressive engagement with the sides of the side lap portion of a previously installed adjacent roofing shingle, such as illustrated in FIG. 26*b*.

As the roofing shingles 300 are applied to the roofing substrate of deck of a roof structure, as indicated in FIG. 25, they will be sealed and attached to the roofing substrate of deck by the applied adhesive material, thereafter, successive roofing shingles 300' will be applied with their side lap portions 310 fitted over and overlapping corresponding side lap portions of previously installed horizontally or laterally adjacent roofing shingles. The compressive or press-fit engagement between the side lap portions of adjacent roofing shingles help hold the roofing shingles in place in an interlocked arrangement.

Sealant or adhesive materials 315' further can be applied along the side lap portions of the roofing shingles before a next roofing shingle is applied thereover, for example, being applied to top and/or bottom surfaces of the side edges of the overlapped side lap portions 310/310', along a seam 314 defined between laterally adjacent roofing shingles 300/300' to further assist in waterproofing of the installed roofing shingles 300, and formation of water shedding features or pathways along the interconnected roofing shingles.

In addition, fasteners 325 will be inserted through the roofing shingles and into the roofing substrate or deck to secure longitudinally and laterally adjacent roofing shingles together and to the roof deck or roofing substrate. For example, fasteners can be inserted through the roofing shingles at spaced locations along areas of overlap 326 between the headlap portions and bottom edges of longitudinally or vertically adjacent roofing shingles 300 and 300', as illustrated in FIG. 25. Fasteners 325 further can be inserted through the overlapping side lap portions between horizontally or laterally adjacent roofing shingles to further help secure the interconnected roofing shingles to the roofing substrate or deck.

The foregoing description generally illustrates and describes various embodiments of a roofing system, including metal shingles for forming a roof structure according to the principles of the present disclosure. It will, however, be understood by those skilled in the art that various changes and modifications can be made to the above-discussed construction of the present disclosure without departing from the spirit and scope of the disclosure as disclosed herein, and that it is intended that all matter contained in the above description or shown in the accompanying drawings shall be interpreted as being illustrative, and not to be taken in a limiting sense. Furthermore, the scope of the present disclosure shall be construed to cover various modifications, combinations, additions, alterations, etc., above and to the above-described embodiments, which shall be considered to be within the scope of the present disclosure. Accordingly, various features and characteristics of the present disclosure as discussed herein may be selectively interchanged and applied to other illustrated and non-illustrated embodiments of the disclosure, and numerous variations, modifications, and additions further can be made thereto without departing from the spirit and scope of the present disclosure.

The invention claimed is:

1. A roof structure, comprising:

a substrate; and a plurality of metal roofing shingles positioned over the substrate, wherein each of the metal roofing shingles comprises:

a body having a plurality of peripheral edges;

wherein the plurality of peripheral edges of the body include a forward edge, a rear edge, and side edges; and at least one headlap feature defined along the rear edge of the body;

wherein the body includes a main body portion defined between the forward edge and the at least one headlap feature;

wherein each side edge comprises a substantially flat side lap region that is part of the body and extends substantially along an entire length of each side edge;

wherein the main body portion includes an upper surface that extends between the side edges of the body and is continuously planar from one side edge to an opposite side edge and across the side lap region of each side edge;

wherein the plurality of metal roofing shingles are configured to be installed along the substrate in courses of the metal roofing shingles with at least one side lap region of one or more metal roofing shingles of a same horizontally extending course of the metal roofing shingles overlapping and lying substantially flat against a side lap region of an adjacent metal roofing shingle in the same horizontally extending course of the metal roofing shingles, and with an upper surface of the at least one side lap region remaining exposed to elements; and wherein the forward edges of the one or more metal roofing shingles are configured to overlap rear edges of the metal roofing shingles in a lower course of the metal roofing shingles when installed along the substrate to connect the one or more metal roofing shingles to the metal roofing shingles of the lower course of the metal roofing shingles.

2. The roof structure of claim 1, further comprising a sealant material applied along the at least one side lap region of the one or more metal roofing shingles; wherein the sealant material is applied to an upper surface or a bottom surface of the at least one side lap region and is configured to adhesively connect the at least one side lap region to the side lap region of the adjacent metal roofing shingle in the same horizontally extending course of the metal roofing shingles.

3. The roof structure of claim 2, wherein the sealant material comprises a pressure sensitive adhesive.

4. The roof structure of claim 2, wherein the sealant material further comprises a bead, strip, or patterned arrangement of a pressure sensitive adhesive with a release material covering strip applied thereto.

5. The roof structure of claim 1, wherein each metal roofing shingle of the plurality of metal roofing shingles comprises at least one interlocking feature configured to interlock with a corresponding interlocking feature of at least one metal roofing shingle of the lower course of the metal roofing shingles.

6. The roof structure of claim 5, wherein the at least one interlocking feature comprises one or more tongue and groove features, serrations, hooked features, domed or arched features, ridges, projections, tabs, or combination thereof.

7. The roof structure of claim 5, further comprising a sealant material applied along an area of overlap between interlocking features of connected metal roofing shingles.

8. The roof structure of claim 1, further comprising a sealant material applied along the body of each metal roofing shingle adjacent to at least one side lap region thereof; wherein the sealant material is applied to an upper surface or a bottom surface of the at least one side lap region and is configured to adhesively connect the at least one side lap region to the side lap region of the adjacent metal roofing shingle; and wherein the at least one headlap feature comprises a hooked feature, bend, tab, tongue and groove feature, serrations, domed or arched feature, ridge, projection, or a combination thereof, configured to engage a corresponding hooked feature, bend, tab, tongue and groove feature, serrations, domed or arched feature, ridge, projection, or a combination thereof, of at least one metal roofing shingle of the lower course of the metal roofing shingles.

9. The roof structure of claim 1, further comprising a bead, strip, or patterned arrangement of a pressure sensitive adhesive having a release material covering strip, the pressure sensitive adhesive applied along the body adjacent the at least one side lap region, the at least one headlap feature, or a combination thereof.

10. The roof structure of claim 1, further comprising an underlayment positioned between the metal roofing shingles and the substrate.

11. The roof structure of claim 1, wherein the metal roofing shingles of the plurality of metal roofing shingles are substantially a same size.

12. The roof structure of claim 1, wherein the at least one headlap feature of each of the metal roofing shingles comprises a bend, tab or hooked portion defined adjacent the rear edge thereof; and wherein each of the metal roofing shingles further comprises a bend, tab or hooked portion defined adjacent the forward edge thereof and configured to engage a corresponding bend, tab or hooked portion of the at least one headlap feature of at least one metal roofing shingle of the lower course of the metal roofing shingles.

13. The roof structure of claim 12, further comprising a sealant material applied along at least a portion of the at least one headlap feature and at least one side lap region of each metal roofing shingle of the plurality of metal roofing shingles.

14. A roof structure, comprising:

a substrate;

an underlayment positioned along the substrate; and a plurality of metal roofing shingles positioned over the underlayment; wherein each of the metal roofing shingles comprises:

a body having a forward edge, a rear edge, and side edges;

headlap alignment features defined along the forward and rear edges of the body; and side lap regions defined substantially along an entire length of each of the side edges;

wherein the body includes a main body portion defined between the headlap alignment features of the metal roofing shingle;

wherein the side lap regions are substantially flat and are part of the body;

wherein the main body portion includes an upper surface that extends between the side edges of the body and is continuously planar from one side edge to an opposite side edge and across the side lap region of each side edge; and wherein the side lap regions of the metal roofing shingles are each configured to overlap and lie substantially flat against a side lap region of an adjacent metal roofing shingle when the headlap alignment features of the metal roofing shingles of a higher course of the metal roofing shingles and a lower course of the metal roofing shingles are coupled together;

wherein the metal roofing shingles of the plurality of metal roofing shingles are configured to be installed along the substrate in a plurality of courses of roofing shingles with a side lap region of one or more of the metal roofing shingles of a same horizontally extending course of the metal roofing shingles overlapping and lying substantially flat against a side lap region of a horizontally adjacent metal roofing shingle in the same horizontally extending course of the metal roofing shingles, and with an upper surface of the side lap region of each of the one or more metal roofing shingles remaining exposed to elements; and wherein the headlap alignment features defined along the forward edges of the one or more metal roofing shingles are configured to engage with corresponding headlap alignment features defined along the rear edges of the metal roofing shingles in a lower course of the metal roofing shingles when installed along the substrate to connect the one or more metal roofing shingles to the metal roofing shingles of the lower course of the metal roofing shingles.

15. The roof structure of claim 14, wherein each metal roofing shingle further comprises a plurality of fastener openings adjacent the headlap alignment feature defined along the rear edge of the body of each metal roofing shingle and each configured to receive a fastener therein for securing the metal roofing shingle to the substrate.

16. The roof structure of claim 14, wherein each of the metal roofing shingles of the plurality of metal roofing shingles are substantially a same size.

17. The roof structure of claim 14, further comprising a sealant material applied along at least one side lap region of each metal roofing shingle; wherein the sealant material is applied to an upper surface or a bottom surface of the body of the metal roofing shingle and is configured to adhere the at least one side lap region of the metal roofing shingle to a side lap region of the horizontally adjacent metal roofing shingle.

18. The roof structure of claim 14, further comprising a sealant material applied along at least a portion of at least one of the headlap alignment features defined along the forward and rear edges and at least one of the side lap regions.

* * * * *